US008807722B2

(12) United States Patent
Kato

(10) Patent No.: US 8,807,722 B2
(45) Date of Patent: Aug. 19, 2014

(54) INK CARTRIDGE AND INKJET PRINTER

(75) Inventor: Yoshinori Kato, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 13/550,987

(22) Filed: Jul. 17, 2012

(65) Prior Publication Data

US 2013/0027481 A1 Jan. 31, 2013

(30) Foreign Application Priority Data

Jul. 29, 2011 (JP) ..... 2011-166911

(51) Int. Cl.
*B41J 2/175* (2006.01)

(52) U.S. Cl.
CPC ..... *B41J 2/17513* (2013.01); *B41J 2/1752* (2013.01)
USPC ..... 347/86

(58) Field of Classification Search
CPC ..... B41J 2002/17516; B41J 2002/17586; B41J 2/17556; B41J 2/17513
USPC ..... 347/86
See application file for complete search history.

(56) References Cited

U.S. PATENT DOCUMENTS

| | | | | |
|---|---|---|---|---|
| 5,940,102 | A | 8/1999 | Watanabe et al. | |
| 5,975,686 | A * | 11/1999 | Hauck et al. | 347/85 |
| 6,137,513 | A | 10/2000 | Pawlowski, Jr. et al. | |
| 6,158,848 | A * | 12/2000 | Liu | 347/85 |
| 6,158,853 | A * | 12/2000 | Olsen et al. | 347/86 |
| 6,203,149 | B1 | 3/2001 | Watanabe et al. | |
| 6,290,345 | B1 | 9/2001 | Sasaki et al. | |
| 6,386,693 | B1 * | 5/2002 | Michele et al. | 347/86 |
| 6,543,886 | B1 | 4/2003 | Hattori et al. | |
| 6,609,789 | B1 * | 8/2003 | Hunt | 347/86 |
| 6,924,054 | B2 * | 8/2005 | Prasad et al. | 429/416 |
| 6,973,409 | B1 * | 12/2005 | Shimizu et al. | 702/173 |
| 7,216,963 | B2 * | 5/2007 | Takagi | 347/86 |
| 7,698,936 | B2 * | 4/2010 | Curello et al. | 73/149 |
| 8,091,993 | B2 | 1/2012 | Gilson et al. | |
| 2005/0151813 | A1 | 7/2005 | Ikezaki | |
| 2011/0057997 | A1 | 3/2011 | Takeuchi | |
| 2012/0081481 | A1 | 4/2012 | Gilson et al. | |
| 2012/0154491 | A1 | 6/2012 | Price et al. | |

FOREIGN PATENT DOCUMENTS

| | | | |
|---|---|---|---|
| EP | 0607928 | A2 | 7/1994 |
| EP | 0791465 | A2 | 8/1997 |
| EP | 1065061 | A2 | 1/2001 |
| EP | 1769922 | A1 | 4/2007 |
| EP | 2292431 | A1 | 3/2011 |
| JP | 2005-199496 | A | 7/2005 |
| WO | 2009/143422 | A2 | 11/2009 |

* cited by examiner

*Primary Examiner* — Matthew Luu
*Assistant Examiner* — Patrick King
(74) *Attorney, Agent, or Firm* — Fox Rothschild LLP

(57) ABSTRACT

An ink cartridge includes an ink bag including two flexible sheets disposed to face each other, a plug, a case including a first wall portion and a second wall portion arranged in parallel, a third wall portion arranged perpendicularly with respect to the pair of wall portions, and a penetration portion, the case housing the ink bag such that sheet surfaces of the two sheets respectively face the first wall portion and the second wall portion, and a pressing member including a curved portion toward the outside and a sheet having lower flexibility than that of the two sheets, wherein between the ink bag and the first wall portion, the pressing member is elastically deformed and a restoring force occurs by one section of the curved portion contacting with the first wall portion and another section of the curved portion contacting with one of the two sheets.

5 Claims, 18 Drawing Sheets

INK CARTRIDGE AND INKJET PRINTER

CROSS-REFERENCE TO RELATED APPLICATION

This Application claims priority from JP2011-166911, filed on Jul. 29, 2011, the content of which is hereby incorporated by reference.

BACKGROUND

The present disclosure relates to an ink cartridge including an ink bag that stores ink and a case that stores the ink bag, and to an inkjet printer in which the ink cartridge can be removably inserted.

Generally, an inkjet printer (hereinafter simply referred to as a printer in some cases) has a structure in which an ink cartridge (hereinafter simply referred to as a cartridge in some cases) for supplying ink to a print head can be inserted into and removed from the printer. In general, the cartridge includes a flexible ink bag, a plug that is connected to the ink bag and that draws out the ink provided in the ink bag, and a rectangular box-shaped case that houses the ink bag. Further, in order that the printer can detect a remaining amount of the ink, the cartridge is sometimes provided with a member that moves inside the case in accordance with a reduction in the amount of ink remaining inside the ink bag. A cartridge is known in which a detection plate is bonded to the ink bag and a position of the detection plate drops as the amount of remaining ink decreases.

SUMMARY

In the above-described cartridge, when the amount of remaining ink decreases, the ink bag deflates. The detection plate descends as the ink bag deflates. As there is no deformation of the detection plate, pressure caused by the weight of the detection plate itself operates uniformly in the downward direction. The ink inside the ink bag moves in accordance with the pressure, and is dispersed toward the periphery of the detection plate. As a result, the cartridge cannot efficiently move the ink remaining in the ink bag toward the plug. Furthermore, for example, when there is no detection plate inside the case of the cartridge, the ink bag deforms in accordance with the amount of ink inside the ink bag and the ink moves. In this case also, there are cases in which it is wished to move the ink toward the plug more efficiently.

The present disclosure provides an ink cartridge and an inkjet printer that are capable of efficiently moving ink inside an ink bag toward a plug.

An ink cartridge according to a first aspect of the present disclosure is provided with an ink bag, a plug, a case and a pressing member. The ink bag is formed in a bag shape, includes two layers of flexible sheets that are disposed to face each other, and stores ink inside. The plug is provided on the ink bag and includes a hollow portion that leads from a first opening that is communicatively connected with the ink bag to a second opening that opens to the outside. The case is substantially box-shaped. The case includes a first wall portion, a second wall portion, a third wall portion and a penetration portion. The first wall portion and the second wall portion, whose longitudinal direction is an axial line of the plug, are a pair of wall portions arranged substantially in parallel with the axial line. The third wall portion is a wall portion that is arranged substantially perpendicularly with respect to an extension direction of the pair of wall portions and diagonally with respect to the axial line. The penetration portion is provided in the third wall portion such that the penetration portion faces the second opening of the plug. The case houses the ink bag such that sheet surfaces of the two layers of sheets respectively face the first wall portion and the second wall portion. The pressing member includes a curved portion, which is a surface portion formed by curving, toward the outside, a sheet having lower flexibility than that of the two layers of sheets such that a first surface that is one surface of the sheet is on an inner side and such that at least one end portion of the sheet faces the first surface. Inside the case, between the ink bag and the first wall portion, the pressing member is elastically deformed and a restoring force occurs by one section of the curved portion being in contact with the first wall portion and another section other than the one section of the curved portion being in contact with a first layer portion that is one of the two layers of sheets.

An inkjet printer according to a second aspect of the present disclosure is provided with an ink cartridge and a cartridge mounting portion in which the ink cartridge is removably inserted. The ink cartridge is provided with an ink bag, a plug, a case and a pressing member. The ink bag is formed in a bag shape, includes two layers of flexible sheets that are disposed to face each other, and stores ink inside. The plug is provided on the ink bag and includes a hollow portion that leads from a first opening that is communicatively connected with the ink bag to a second opening that opens to the outside. The case is substantially box-shaped. The case includes a first wall portion, a second wall portion, a third wall portion and a penetration portion. The first wall portion and the second wall portion, whose longitudinal direction is an axial line of the plug, are a pair of wall portions arranged substantially in parallel with the axial line. The third wall portion is a wall portion that is arranged substantially perpendicularly with respect to an extension direction of the pair of wall portions and diagonally with respect to the axial line. The penetration portion is provided in the third wall portion such that the penetration portion faces the second opening of the plug. The case houses the ink bag such that the axial line of the plug is positioned closer to a first end portion that is one end portion of the case, in a direction that orthogonally intersects with the axial line, and such that sheet surfaces of the two layers of sheets respectively face the first wall portion and the second wall portion. The pressing member includes a curved portion, which is a surface portion formed by curving, toward the outside, a sheet having lower flexibility than that of the two layers of sheets such that a first surface that is one surface of the sheet is on an inner side and such that at least one end portion of the sheet faces the first surface. The pressing member is arranged inside the case between the ink bag and the first wall portion such that the pressing member is elastically deformed and a restoring force occurs by one section of the curved portion being in contact with the first wall portion and another section other than the one section being in contact with a first layer portion that is one of the two layers of sheets, and such that a curved end portion is positioned closer to the first end portion than the axial line. The cartridge mounting portion is structured such that the ink cartridge is mounted in a posture in which the first wall portion and the second wall portion extend in the up-down direction, and the first end portion of the case is on a lower side.

An ink cartridge according to a third aspect of the present disclosure is provided with an ink bag, a plug, a case and a pressing member. The ink bag is formed in a bag shape, includes two layers of flexible sheets that are disposed to face each other, and stores ink inside. The plug is provided on the ink bag and includes a hollow portion that leads from a first opening that is communicatively connected with the ink bag to a second opening that opens to the outside. The case is substantially box-shaped. The case includes a first wall portion, a second wall portion, a third wall portion and a penetration portion. The first wall portion and the second wall portion, whose longitudinal direction is an axial line of the plug, are a pair of wall portions arranged substantially in parallel with the axial line. The third wall portion is a wall portion that is arranged substantially perpendicularly with respect to an extension direction of the pair of wall portions, and diagonally with respect to the axial line. The penetration portion is provided in the third wall portion such that the penetration portion faces the second opening of the plug. The case houses the ink bag such that sheet surfaces of the two layers of sheets respectively face the first wall portion and the second wall portion. The pressing member includes a curved portion, which is a surface portion formed by curving, toward the outside, a sheet having lower flexibility than that of the two layers of sheets such that a first surface that is one surface of the sheet is on an inner side and such that at least one end portion of the sheet faces the first surface. Inside the case, between the first wall portion and the second wall portion, a force is applied to the pressing member by one section of the curved portion being in contact with the first wall portion and another section other than the one section of the curved portion being in contact with a first layer portion that is one of the two layers of sheets.

BRIEF DESCRIPTION OF THE DRAWINGS

Exemplary embodiments of the disclosure will be described below in detail with reference to the accompanying drawings in which.

DETAILED DESCRIPTION OF THE EXEMPLARY EMBODIMENTS

Figure 1:
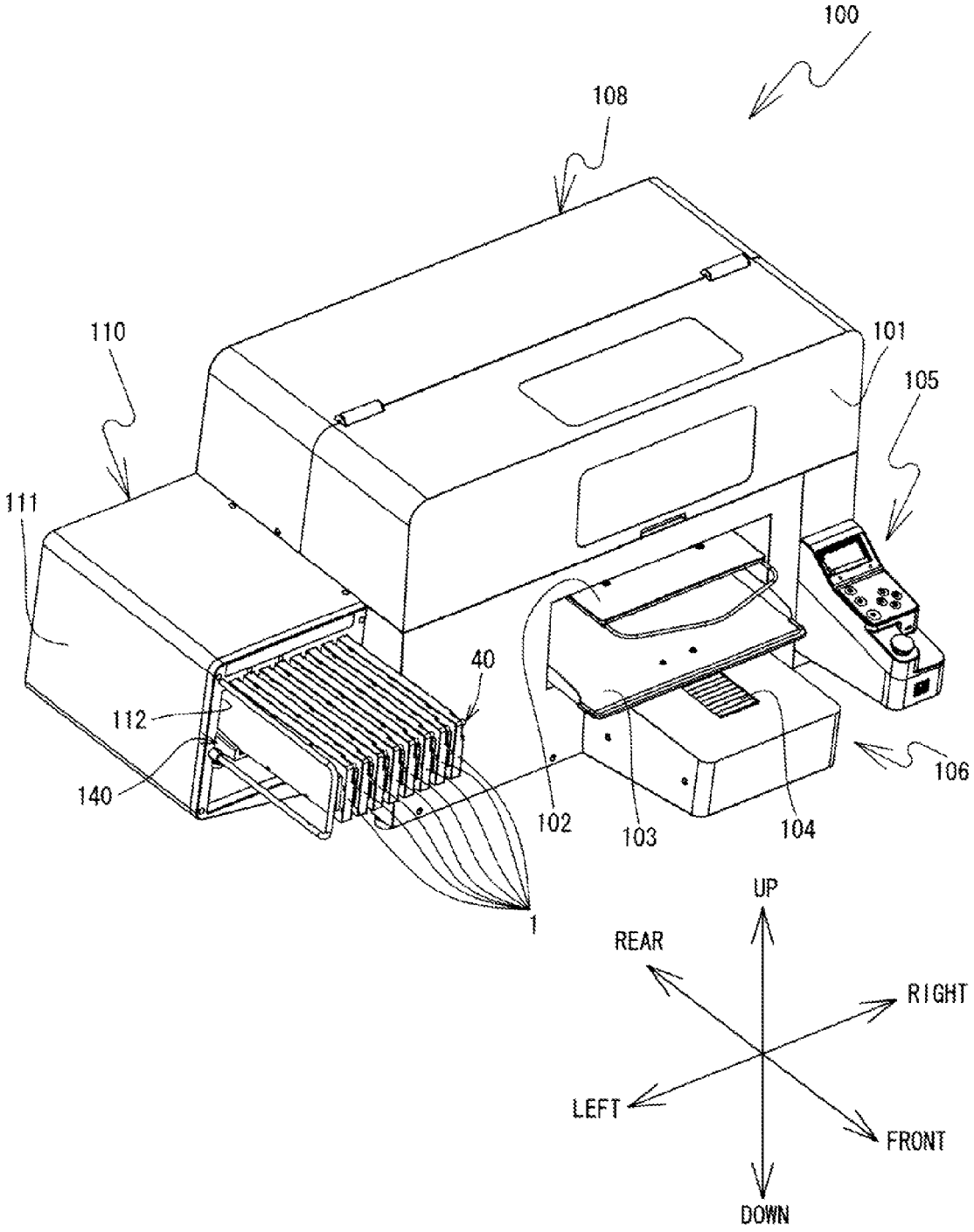
FIG. 1 is a perspective view of an inkjet printer 100.

Hereinafter, an embodiment of the present disclosure will be explained with reference to the appended drawings. In the present embodiment, an inkjet printer (hereinafter, in some cases simply referred to as a printer) 100 that performs printing on a fabric such as a t-shirt etc., and an ink cartridge (hereinafter, in some cases simply referred to as a cartridge) 1 that is used in the printer 100 will be explained.

A schematic structure of the printer 100 will be explained with reference to FIG. 1. The printer 100 is a printer that can perform printing on a fabric (such as a t-shirt etc.), which is a printing medium, by a print head (not shown in the drawings) using ink supplied from the cartridge 1. An up-down direction, a lower right direction, an upper left direction, a lower left direction and an upper right direction in FIG. 1 respectively correspond to an up-down direction, a front direction, a rear (back) direction, a left direction and a right direction of the printer 100 and the cartridge 1.

As shown in FIG. 1, the printer 100 includes a body portion 108 having a substantially rectangular parallelepiped shape and a cartridge mounting unit 110 having a substantially rectangular parallelepiped shape that is smaller than the body portion 108. The body portion 108 is a portion that performs printing using a print head while moving a fabric, and has a similar structure to that of a known inkjet printer for fabric printing. The cartridge mounting unit 110 is a portion in which the cartridge 1 that supplies ink is inserted. The cartridge mounting unit 110 is detachably attached to a lower left portion of the body portion 108.

The body portion 108 is provided with a housing 101.

A platen drive mechanism 106 is provided in a central portion in the left-right direction of the body portion 108. The platen drive mechanism 106 includes a platen 102, a tray 103, a drive belt 104, a pair of guide rails (not shown in the drawings), a platen drive motor (not shown in the drawings) and the like.

The drive belt 104 is stretched between pulleys (not shown in the drawings) that are respectively arranged at front and rear sides of the body portion 108. The platen 102 and the tray 103, each having a rectangular plate shape, are supported by a support pillar (not shown in the drawings) that is fixed above the drive belt 104. A fabric that is the print medium is placed on an upper surface of the platen 102. The tray 103 is disposed below and substantially parallel to the platen 102. The tray 103 is a plate-like body that is one size larger than the platen 102. The tray 103 inhibits a part of the fabric (a sleeve etc. of the t-shirt) placed on the platen 102 from falling down. The pair of guide rails extend in the front-rear direction above the drive belt 104 and guide the platen 102 and the tray 103. The platen drive motor drives the drive belt 104 via the above-described pulleys. When the platen drive motor drives the drive belt 104, the platen 102 and the tray 103 move in the front-rear direction along the guide rails, via the support pillar. An opening is provided in a central portion of a front surface of the housing 101, and the platen 102 and the tray 103 enter and leave the housing 101 via the opening.

A pair of guide rails (not shown in the drawings) are disposed inside the housing 101 of the body portion 108, in a substantially central position in the front-rear direction and above the platen 102. The guide rails extend in the left-right direction and support a carriage of print heads. The print heads are fixed below the carriage. Although the number of the print heads differs depending on a type of the inkjet printer, the number of the print heads of the printer 100 is eight. The carriage is moved in the left-right direction along the guide rails by a carriage drive mechanism that includes a carriage drive motor and a belt transmission mechanism. The eight print heads are respectively supplied, via a tube 182 (refer to FIG. 6), with ink from the eight cartridges 1 that are inserted in the cartridge mounting unit 110. A plurality of fine nozzles are provided on a bottom surface of each of the print heads, and droplets of the ink are ejected downward from the nozzles by driving a piezoelectric element. Thus, the printer 100 performs printing on the fabric by ejecting the ink from the nozzles while moving the platen 102 (on which the fabric is placed) and the carriage.

An operation portion 105 is provided on a lower right portion of a front surface of the body portion 108. The operation portion 105 is provided with a display that displays various types of information, and buttons etc. that are used to input commands corresponding to various operations of the printer 100.

A total of the eight cartridges 1 can be inserted in the cartridge mounting unit 110. Normally, the four ink cartridges 1 for storing white ink, and the four ink cartridges 1 for respectively storing four colors of ink, i.e., cyan, magenta, yellow and black ink, are used as the eight cartridges 1. The cartridge mounting unit 110 is provided with a housing 111. Although not shown in the drawings, an opening is provided on the right side of the housing 111. The cartridge mounting unit 110 includes a fixing portion to detachably fix the cartridge mounting unit 110 to the body portion 108 via the opening. The cartridge mounting unit 110 is fixed to a receiving portion (not shown in the drawings) of the body portion 108 using a screw via the fixing portion, for example. The cartridge mounting unit 110 is formed as a general-purpose unit that can also be attached to and removed from another type of inkjet printer having print heads whose number is other than eight. Although not shown in the drawings, another type of cartridge, which is shorter than the cartridge 1, can also be inserted into and removed from the cartridge mounting unit 110.

An opening 112 having a substantially rectangular shape that is long in the left-right direction is provided in the upper portion of the front surface of the housing 111. The cartridge mounting unit 110 is provided with a holder unit 150 (refer to FIG. 11) that is arranged to the rear of the opening 112, namely, inside the housing 111. A user inserts and removes each of the cartridges 1 into and from the holder unit 150 (more specifically, a holder 159) inside the housing 111, via the opening 112. To the rear of the holder unit 150, the cartridge mounting unit 110 is provided with a connection portion 180 (refer to FIG. 6) that includes a lead-out needle 183 to draw out the ink. The housing 111 is provided with a guide portion 140 that protrudes forward from the front surface of the housing 111 along a lower edge portion of the opening 112. The guide portion 140 guides the cartridge 1 so that the cartridge 1 is smoothly inserted into an appropriate one of the holders 159 (refer to FIG. 12) via the opening 112. An internal structure of the cartridge mounting unit 110 will be described in more detail later.

A structure of the cartridge 1 will be explained with reference to FIG. 2 to FIG. 10. The cartridge 1 is provided with a case 2, an ink pack 7, a movable member 5 and a pressing member 8. The case 2 is a thin and substantially box-shaped case that is long in the front-rear direction, and is made of plastic, for example. The case 2 houses the ink pack 7 and the pressing member 8. Hereinafter, structures of the case 2, the ink pack 7, the movable member 5 and the pressing member 8 will be explained in order. Note that the cartridges 1 of the five colors have the same structure, and differ only in that the colors of the liquid ink stored in the ink packs 7 are different from each other.

Figure 2:
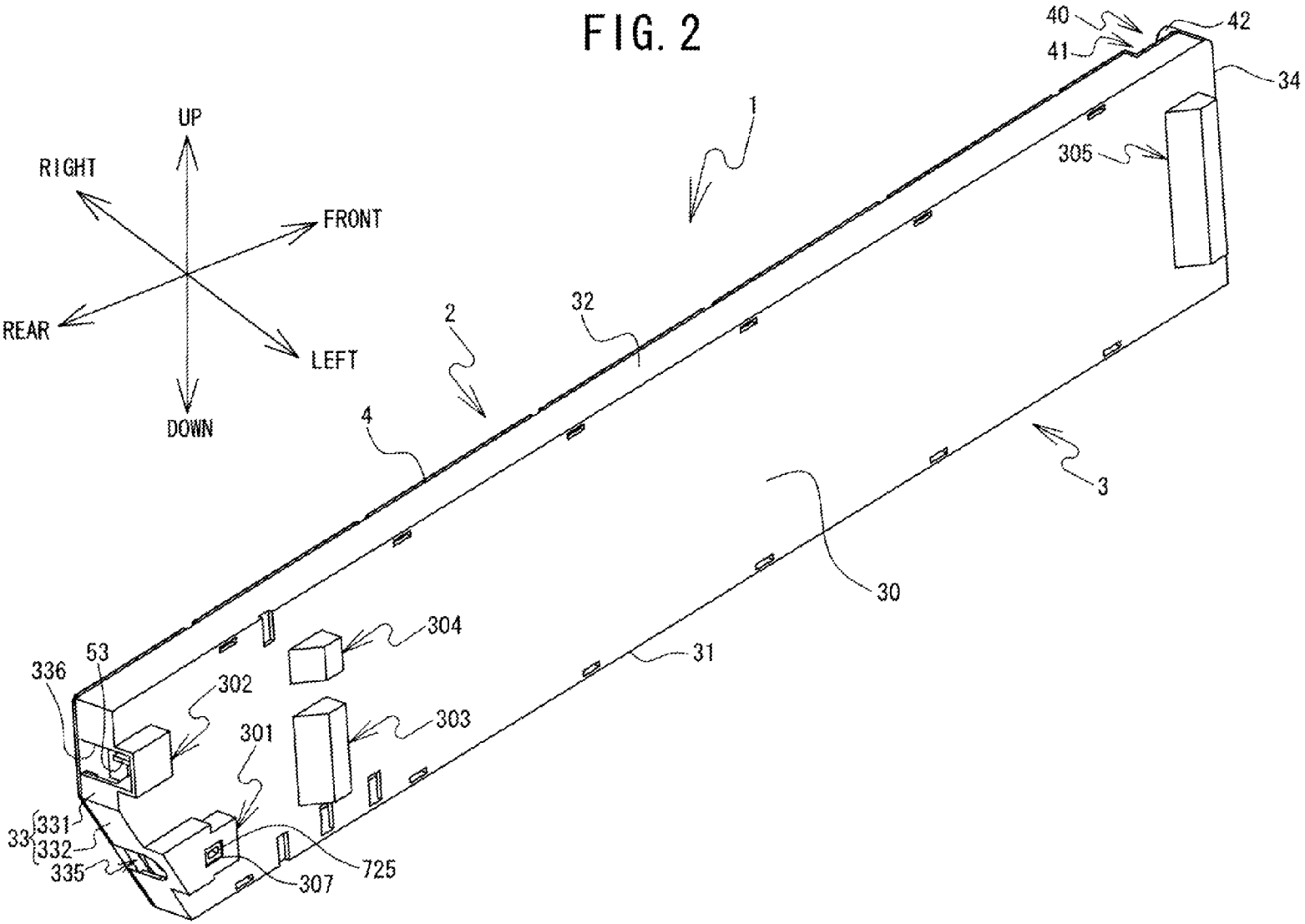
FIG. 2 is a perspective view of an ink cartridge 1 as viewed from the rear left.
Figure 3:
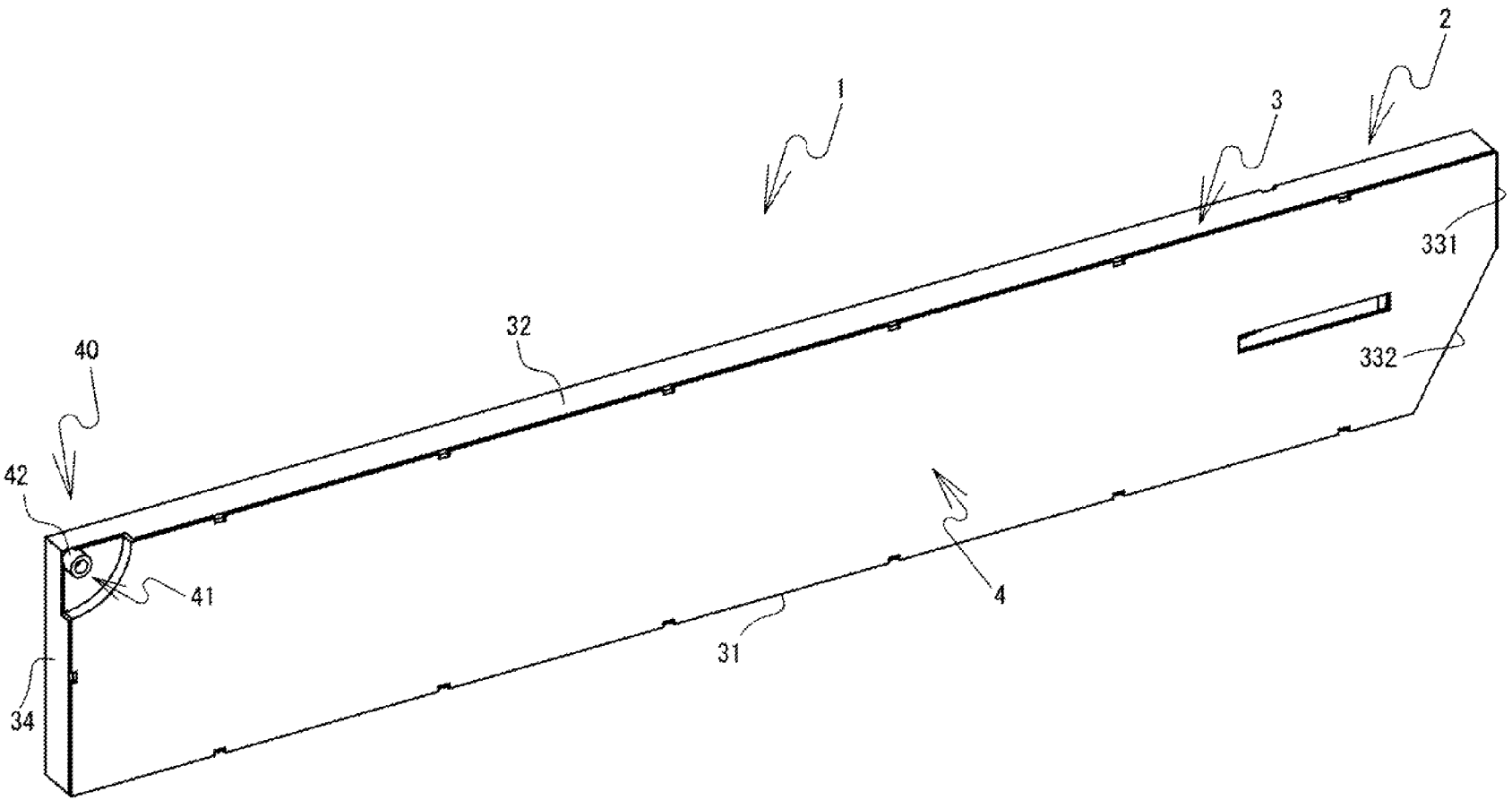
FIG. 3 is a perspective view of the ink cartridge 1 as viewed from the front right.
Figure 4:
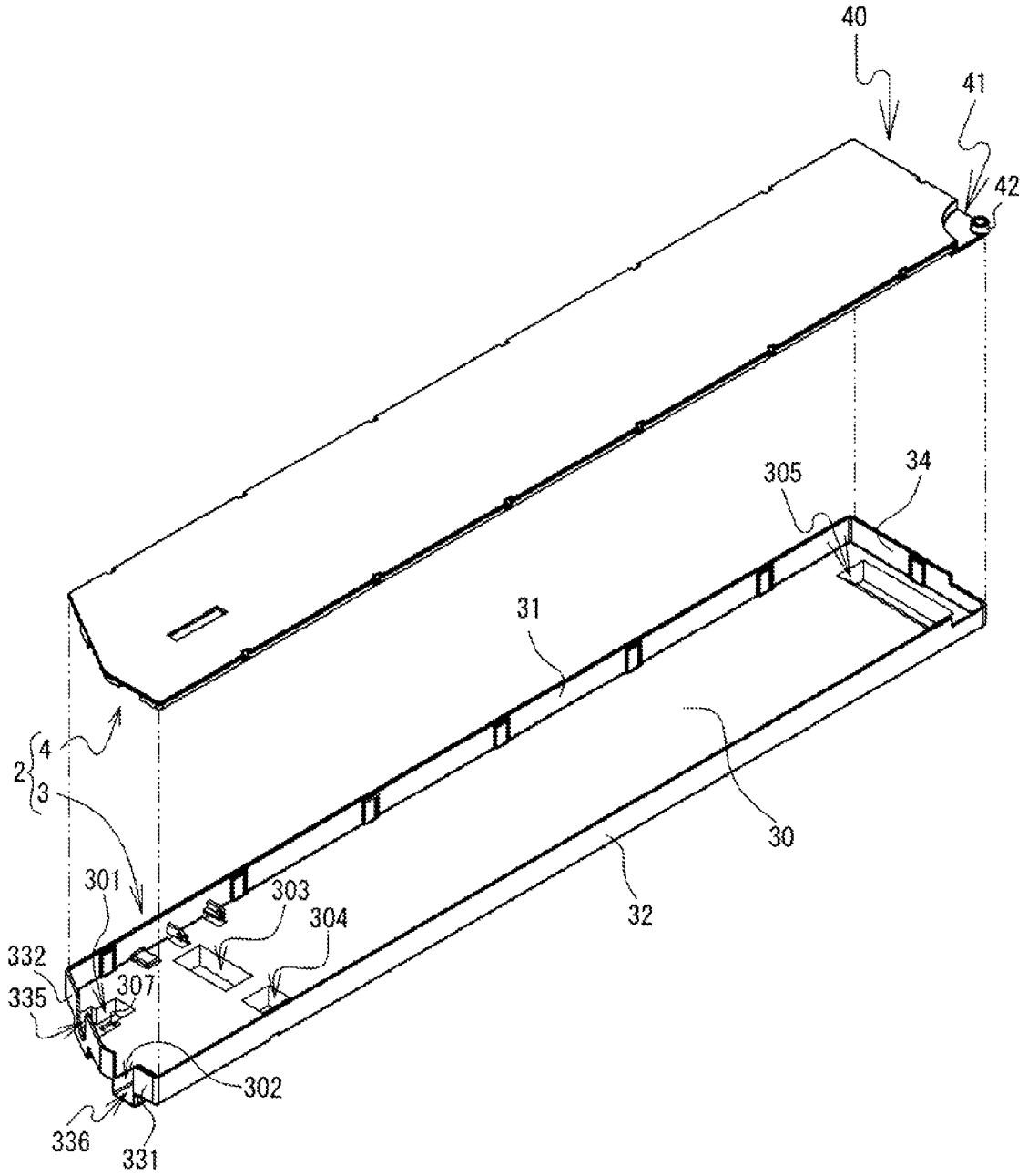
FIG. 4 is an exploded perspective view of a case 2.

First, the structure of the case 2 will be explained with reference to FIG. 2 to FIG. 4. As shown in FIG. 2 and FIG. 3, as a whole, the case 2 has a rectangular parallelepiped shape that is long in the front-rear direction and thin in the left-right direction, and a corner at the lower rear end of the case 2 is diagonally cut out. As shown in FIG. 4, the case 2 includes a main body portion 3 and a lid portion 4.

As shown in FIG. 4, the main body portion 3 includes a left wall 30, a bottom wall 31, a top wall 32, a rear wall 33 and a front wall 34 that each have a thin plate shape. The bottom wall 31, the top wall 32, the rear wall 33 and the front wall 34 extend along a periphery of the left wall 30 (which has a substantially pentagonal shape), each extending substantially perpendicularly with respect to an extension direction of the left wall 30 and each having a substantially same length. The left wall 30, the bottom wall 31, the top wall 32, the rear wall 33 and the front wall 34 respectively form a left side surface, a bottom surface, a top surface, a back surface and a front surface of the case 2. The rear wall 33 includes a back surface portion 331 and an inclined surface portion 332. The back surface portion 331 is connected to the top wall 32 such that they form a right angle. The inclined surface portion 332 diagonally connects the bottom wall 31 and the back surface portion 331. The bottom wall 31 forms a corner portion with the inclined surface portion 332, and the back surface portion 331 forms a corner portion with the inclined surface portion 332, each having an obtuse angle. The lid portion 4 faces the left wall 30 and forms a right side surface of the case 2. The lid portion 4 is a thin plate member and has a substantially pentagonal shape corresponding to the left wall 30 of the main body portion 3. The case 2 is formed by joining the lid portion 4 to the main body portion 3 (specifically, the bottom wall 31, the top wall 32, the rear wall 33 and the front wall 34) such that the left wall 30 and the lid portion 4 face each other in a substantially parallel manner.

As shown in FIG. 2 and FIG. 4, five leg portions 301 to 305 that protrude from an outer surface (the left side surface of the case 2) are provided on the left wall 30 of the case 2. Specifically, on the left wall 30, the leg portion 301 and the leg portion 302 are provided respectively in a section that is connected to the inclined surface portion 332 and in a section that is connected to the back surface portion 331. The leg portion 303 and the leg portion 304 are respectively provided on the left wall 30 in positions that are separated from the leg portion 301 and the leg portion 302 toward the front (in the upper right direction in FIG. 2). The leg portion 305 is provided in the vicinity of a front end portion of the left wall 30. Note that all the leg portions 301 to 305 are provided in positions where they do not interfere with an upper rail portion 161 and a lower rail portion 171 of the holder 159 when the cartridge 1 is inserted in the holder 159 (refer to FIG. 11), which will be described later. When the cartridge 1 is placed on a flat surface in a state in which the left wall 30 is on the lower side, the leg portions 301 to 305 have a function of stably supporting the cartridge 1 in a state in which the entire left wall 30 is separated from the flat surface.

As shown in FIG. 2, a plug opening 335 is provided in the inclined surface portion 332 of the rear wall 33 of the case 2, in a position corresponding to the leg portion 301. The plug opening 335 is an opening to draw out the ink from the ink pack 7 (refer to FIG. 5) accommodated in the case 2. The ink pack 7 is arranged in the case 2 such that a second opening 702 of a plug 72 (refer to FIG. 6) faces the plug opening 335. The leg portion 301 that is adjacent to the plug opening 335 also functions as a wall portion that forms a space for accommodating the plug 72. A rectangular shaped engagement hole 307 is provided in the leg portion 301, in the vicinity of a central portion of a flat surface portion of the protruding end. The engagement hole 307 is an opening that is used to determine the position of the plug 72 of the ink pack 7 with respect to the main body portion 3 and to fix the plug 72.

As shown in FIG. 2, an exposure opening 336 is provided in the back surface portion 331 of the rear wall 33 of the case 2, in a position corresponding to the leg portion 302. The exposure opening 336 is an opening that exposes an exposed portion 53, which is part of the movable member 5 (refer to FIG. 5), and allows the user to check a position of the exposed portion 53. The leg portion 302 that is adjacent to the exposure opening 336 also functions as a wall portion that forms a space (a movement space) in which a part of the movable member 5 that includes the exposed portion 53 can move.

As shown in FIG. 2 and FIG. 3, a handle portion 40 is provided on an upper right corner portion (an upper left corner portion of the lid portion 4 in FIG. 3) of a front end portion of the case 2. The handle portion 40 includes a recessed portion 41 and a protruding portion 42. The recessed portion 41 is a portion that is recessed inwardly from the outer surface of the case 2. The protruding portion 42 is a portion that protrudes from the recessed portion 41. The handle portion 40 is used, for example, when the user takes out a given one of the cartridges 1 in a state in which a plurality of the cartridges 1 are inserted in the cartridge mounting unit 110 with a slight gap therebetween (refer to FIG. 1).

Figure 5:
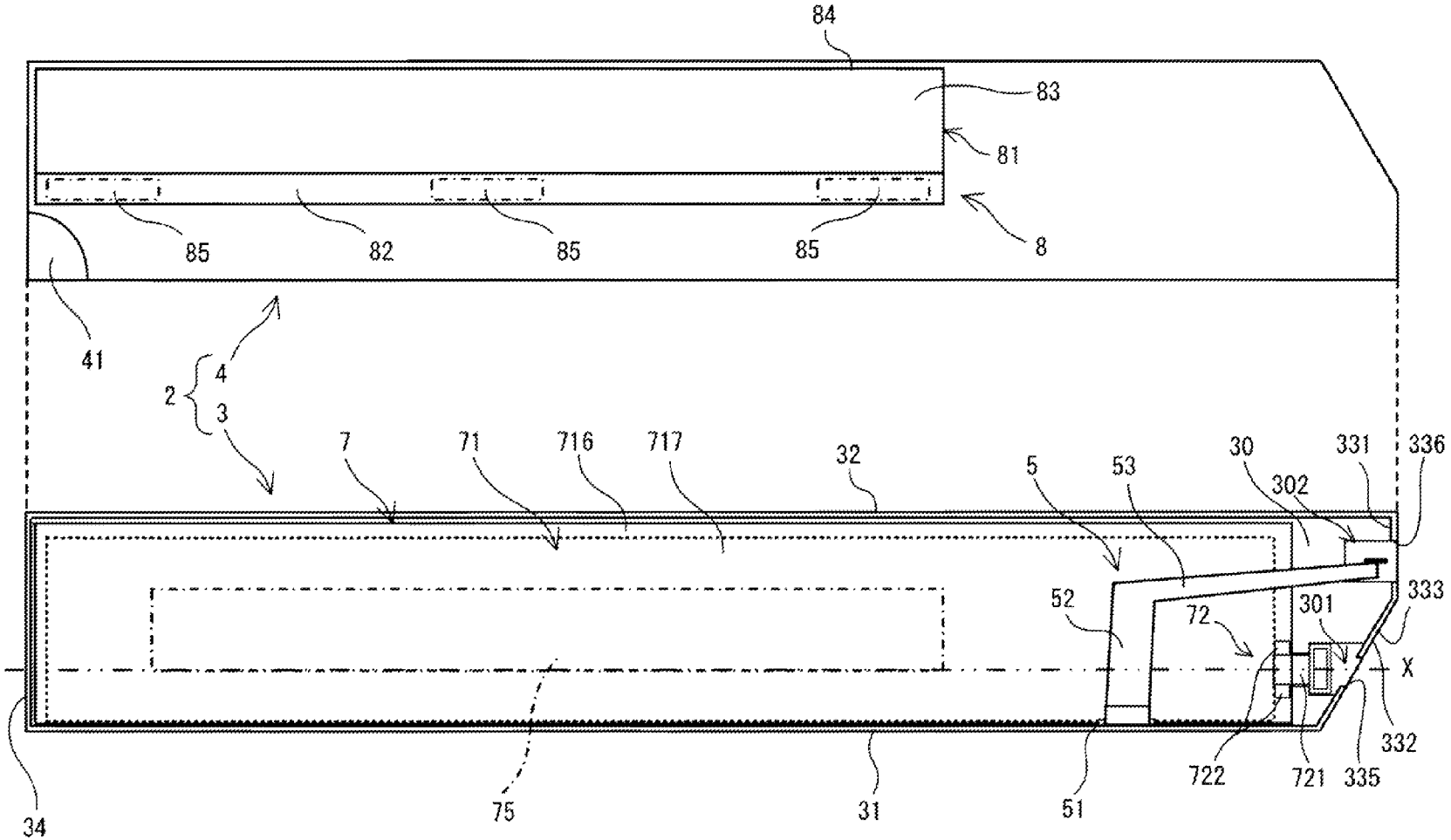
FIG. 5 is an explanatory diagram showing positional relationships of an ink pack 7, a movable member 5 and a pressing member 8.

A structure of the ink pack 7 will be explained with reference to FIG. 5, FIG. 6 and FIG. 10. As shown in FIG. 5, the ink pack 7 includes an ink bag 71 that stores ink and the plug 72 that is provided on the ink bag 71. The ink bag 71 is a bag-shaped container. The ink bag 71 is formed such that two rectangular-shaped flexible plastic sheets are overlapped with each other in a state in which inner surfaces of the sheets face each other, and a surrounding portion along four sides is thermally welded (heat sealed). Each of the sheets has, for example, a three-layered structure in which one layer is polyethylene (with a thickness of approximately 40 μm), one layer is nylon (with a thickness of approximately 15 μm) and one layer is silica deposited polyethylene terephthalate (with a thickness of approximately 12 μm). The ink bag 71 includes a welded peripheral portion 716, and an ink storage portion 717 that is formed by two facing sheets 711 and 712 (refer to FIG. 10). The ink storage portion 717 stores the ink.

It is sufficient for the ink bag 71 to be a bag-shaped container that includes the two flexible sheets 711 and 712 arranged facing each other, thus forming a space in which the ink can be stored between the two sheets 711 and 712. Therefore, for example, the ink bag 71 may be formed such that one rectangular sheet is folded in half to form two layers, and the two layers are joined along three sides other than a folded portion. Two sheets that face each other may be joined along three sides of the two sheets and the remaining one side of each of the two sheets may be joined to another sheet, thus forming the ink bag 71 having a bottom portion. The ink bag 71 may be formed such that four sides of two sheets that face each other are respectively joined to other sheets serving as side surfaces of the ink bag 71. A material of the sheets is not limited to the above-described example. A method for joining the sheets is not limited to welding and another method such as adhesive bonding, for example, may be used.

The plug 72 is provided with a substantially cylindrically shaped body portion 721, and two blade-like coupling portions 722. The coupling portions 722 protrude in directions opposite to each other from an outer peripheral surface of the body portion 721, on one end of the body portion 721. The plug 72 is fixed to the ink bag 71 such that the one end portion of the body portion 721 including the coupling portions 722 is inserted between the two sheets that form the ink bag 71 and is integrally welded with the peripheral portion 716 of the ink bag 71. Other portions of the body portion 721 that are not welded with the peripheral portion 716 protrude to the outside of the ink bag 71 from one end portion in the longitudinal direction of the ink bag 71. The plug 72 is provided on the ink bag 71 such that an axial line X of the body portion 721 (more precisely, a hollow portion 700 that will be described later) is substantially in parallel with the longitudinal direction of the ink bag 71. The axial line X is located closer to one end portion of the ink bag 71 in a direction (a widthwise direction of the ink bag 71) that is orthogonal to the axial line X. In the present embodiment, the plug 72 is provided in the vicinity of one of four corner portions of the ink bag 71.

Figure 6:
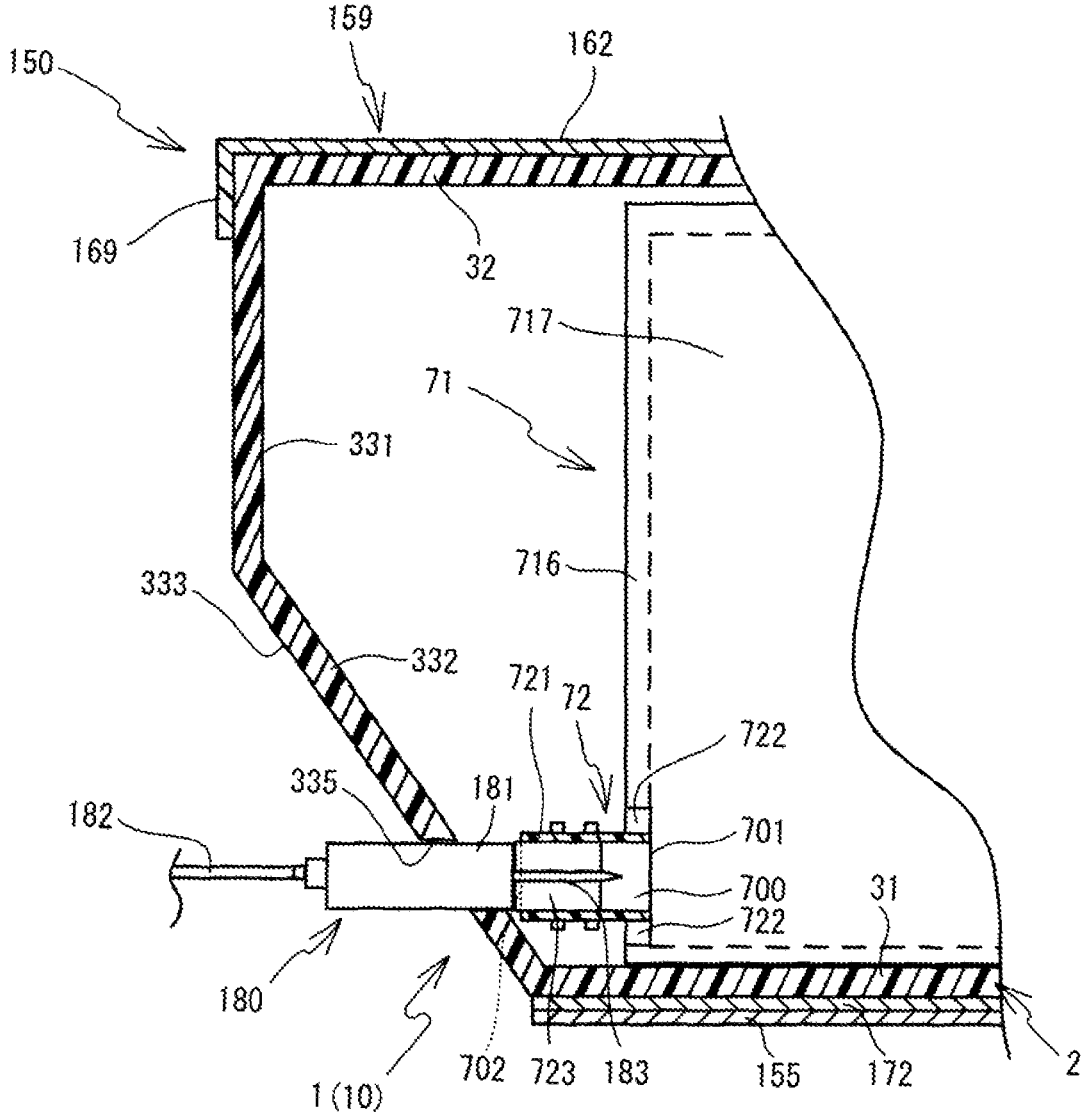
FIG. 6 is an enlarged partial cross-sectional view of a portion surrounding a plug 72 of the ink cartridge 1 when ink is supplied.

As shown in FIG. 6, the cylindrically-shaped hollow portion 700 is provided inside the body portion 721. The hollow portion 700 leads from a first opening 701 to a second opening 702. The first opening 701 is communicatively connected to the ink storage portion 717 of the ink bag 71. The second opening 702 opens to the outside of the ink bag 71. A cylindrical rubber plug 723 is inserted into an end portion on the second opening 702 side of the hollow portion 700. Therefore, the opening on the leading end side of the plug 72 is closed by the rubber plug 723. In this manner, the ink is stored in the ink bag 71 in a sealed state. It is sufficient if the plug 72 is provided on the ink bag 71 such that the ink storage portion 717 communicates with the outside through the hollow portion 700, and a method for fixing the plug 72 is not limited to welding. For example, the plug 72 may be formed integrally with the ink bag 71.

The body portion 721 is substantially cylindrically shaped, but the leading end portion on the side of the second opening 702 of the body portion 721 is formed in a rectangular block shape. The rectangular block-shaped portion is provided with a prism-shaped engagement protrusion 725 (refer to FIG. 2) that protrudes to the outside in a peripheral direction. The position of the plug 72 is determined with respect to the main body portion 3 of the case 2 by the engagement protrusion 725 being engaged with the above-described engagement hole 307 of the leg portion 301 (refer to FIG. 2 and FIG. 4), and thus the plug 72 is fixed.

Figure 7:
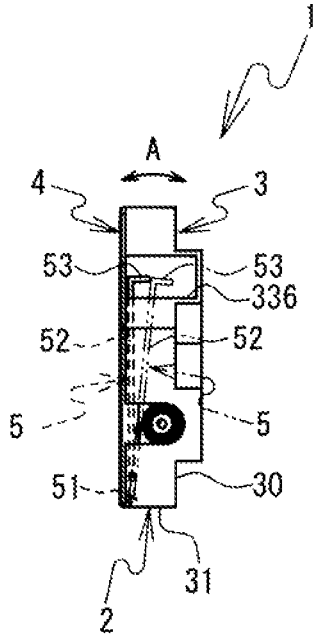
FIG. 7 is an explanatory diagram illustrating movement of the movable member 5.

A structure of the movable member 5 will be explained with reference to FIG. 5 and FIG. 7. As shown in FIG. 5, the movable member 5 includes a shaft portion 51, an arm portion 52 and the exposed portion 53. The arm portion 52 is an L-shaped plate member that is arranged such that plate surfaces face the left wall 30 and the lid portion 4. One end portion of the arm portion 52 is in contact with the bottom wall 31 and the other end portion is positioned in the vicinity of the exposure opening 336. The shaft portion 51 is fixed along the front-rear direction of the case 2, to the rear of the leg portion 303 (refer to FIG. 2) and in the vicinity of the end portion on the side of the lid portion 4. The shaft portion 51 is connected to the one end portion of the arm portion 52 that is in contact with the bottom wall 31, and rotatably supports the arm portion 52 in the left-right direction of the case 2 (as indicated by the two-headed arrow A shown in FIG. 7). A torsion spring (not shown in the drawings) that is provided on the shaft portion 51 urges the arm portion 52 in the direction of the left wall 30 (to the right in FIG. 7). The rectangular plate-shaped exposed portion 53 is connected to the leading end of the arm portion 52. The exposed portion 53 is substantially perpendicular to the plate surfaces of the arm portion 52 and protrudes in the direction of the left wall 30. As shown in FIG. 7, the exposed portion 53 is in a position that can be visually verified through the exposure opening 336.

When the cartridge 1 is initially used, the ink bag 71 is completely filled with ink and is in an inflated state. Accordingly, the ink bag 71 presses the left end portion (the end portion on the right side in FIG. 7) of the exposed portion 53. The arm portion 52 resists the urging force of the torsion spring and rotates around the shaft portion 51 in the direction of the lid portion 4, to a position on the left side shown in FIG. 7. As the amount of remaining ink decreases, the ink bag 71 deflates. As a result, the pressing force on the exposed portion 53 becomes weaker. The arm portion 52 rotates in the direction of the left wall 30 due to the urging force of the torsion spring. When there is no more ink remaining, the exposed portion 53 reaches a position on the right side shown in FIG. 7. As described above, the position of the exposed portion 53 changes in accordance with the amount of ink remaining. The leg portion 302, which is provided on the left wall 30 such that it is connected to the exposure opening 336, secures the movement space of the exposed portion 53. The user can check, from the exposure opening 336, the position of the exposed portion 53 of the movable member 5, and can thus check the amount of ink remaining in the ink bag 71. In other words, the movable member 5 functions as a remaining ink amount indication member.

Figure 8:
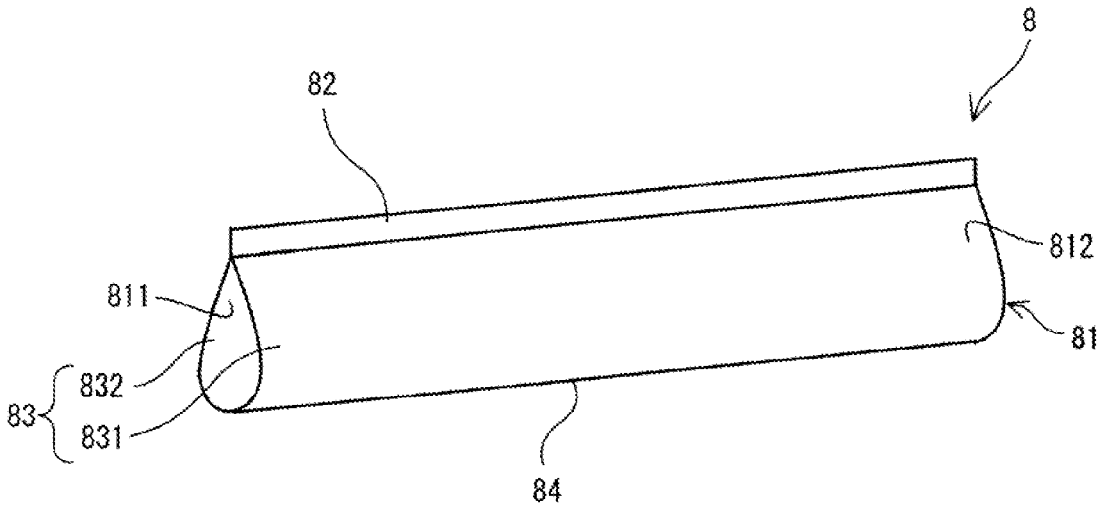
FIG. 8 is a perspective view of the pressing member 8.

A structure of the pressing member 8 will be explained with reference to FIG. 8. The pressing member 8 is a member that is formed by folding a rectangular sheet 81, which has flexibility and which can be elastically deformed, such that a first surface 811, which is one surface of the sheet 81, is on the inside, and a facing pair of ends are joined together on the side of the first surface 811. The sheet 81 is, for example, a polyethylene terephthalate sheet with a thickness of approximately 125 μm, and an outer surface of the sheet 81 is a second surface 812. The flexibility of the sheet 81 is lower than that of the two sheets of the ink bag 71, namely that of the sheet 711 and the sheet 712 (refer to FIG. 10). In other words, the sheets 711 and 712 of the ink bag 71 are more pliable than the sheet 81 of the pressing member 8 and are more easily deformed. Note that, the material and the thickness of the sheet 81 are not limited to the above-described example, and can be selected such that the flexibility of the sheet 81 is lower than the flexibility of the sheets 711 and 712 of the ink bag 71.

The pressing member 8 includes a joint portion 82 and a curved portion 83. The joint portion 82 is a portion at which the facing pair of ends of the sheet 81 are joined. The joint portion 82 may be formed, for example, by being adhered using double-sided adhesive tape, or may be formed by welding. The joint portion 82 may be formed by folding back side surfaces of a cylindrically shaped sheet. The curved portion 83 is a surface portion that is curved and that connects the pair of ends that form the joint portion 82. As the sheet 81 is elastically deformed, the curved portion 83 does not buckle, and maintains a flexed state. Hereinafter, one end portion of the pressing member 8 that faces the joint portion 82 (a portion in a position that is most removed from the joint portion 82, namely where the surface extending from the joint portion 82 curves back toward the joint portion 82) is called a curved end portion 84. The curved portion 83 includes a first surface portion 831 and a second surface portion 832 that face each other, with the curved end portion 84 as a demarcation between them. If an external force is applied to the curved portion 83 from the side of the second surface 812 of the sheet 81, the sheet 81 deflects. As a result, the shape of the curved portion 83 changes and a distance of separation between the first surface portion 831 and the second surface portion 832 changes. In order to secure a degree of freedom of the deflection of the curved portion 83, it is preferable for a width of the joint portion 82 to be sufficiently small in relation to a distance from the joint portion 82 to the curved end portion 84.

Positional relationships between the case 2, the ink pack 7, the movable member 5 and the pressing member 8 will be explained with reference to FIG. 5, FIG. 9 and FIG. 10. As shown in FIG. 5, the ink pack 7 is housed in the case 2 such that the axial line X of the plug 72 substantially matches the longitudinal direction (the front-rear direction) of the case 2, and is substantially parallel to the bottom wall 31, the top wall 32 and the left wall 30. When the lid portion 4 is joined to the main body portion 3, the lid portion 4 is substantially parallel to the left wall 30 and thus the axial line X is substantially parallel to the lid portion 4. Further, the ink pack 7 is arranged inside the case 2 such that the axial line X is positioned closer to one end of the case 2 in a direction that orthogonally intersects the axial line X (in this embodiment, closer to the end on the side of the bottom wall 31). The inclined surface portion 332 (more specifically, an outer surface 333) diagonally intersects the axial line X. An angle that is formed on the inner side of the case 2 between the outer surface 333 that inclines toward the bottom wall 31 and the axial line X is an acute angle that is less than 90 degrees.

Further, the ink pack 7 is housed in the case 2 such that the two sheets 711 and 712 (refer to FIG. 10) extend substantially in parallel with a virtual plane that includes the axial line X of the plug 72 and forms a right angle with the outer surface 333 of the inclined surface portion 332. In the present embodiment, the plane is substantially parallel to the left wall 30 and the lid portion 4, and thus sheet surfaces of the two sheets 711 and 712 extend respectively facing the left wall 30 and the lid portion 4.

As described above, the plug 72 of the ink pack 7 is fixed to the main body portion 3 by the engagement protrusion 725 being engaged with the engagement hole 307 (refer to FIG. 2). In addition, of the two sheets 711 and 712, an area 75 of the sheet 712 that faces the left wall 30 (refer to FIG. 10) is adhered to an inner surface of the left wall 30, and the ink bag 71 is thus partially affixed to the main body portion 3. The area 75 is adhered to the left wall 30 using double-sided adhesive tape, for example. In order to secure a degree of freedom of deformation of the sheets 711 and 712 of the ink bag 71, the area 75 is an area that is smaller than the ink storage portion 717. Further, in order to allow the ink to move smoothly in the direction of the plug 72, the area 75 is provided in a position that is separated from the plug 72 in the direction of the axial line X of the plug 72. In addition, the area 75 is provided in a position that is outside a range of installation of the movable member 5 when the ink bag 71 is arranged in the main body portion 3.

The sheets 711 and 712 that form the ink storage portion 717 have flexibility, and thus, when the amount of ink remaining inside the ink storage portion 717 is large, the two sheets 711 and 712 curve in directions in which they are separated from each other. When the remaining amount of ink is small, the distance between the two sheets 711 and 712 reduces and the two sheets deflect in directions in which they come into contact with each other. In summary, since the two sheets 711 and 712 are not fixed flat surfaces, they are not exactly in parallel with the above-described virtual plane. In particular, as shown in FIG. 10, the area 75 (refer to FIG. 5) of the sheet 712 of the ink bag 71 of the present embodiment is adhered to the left wall 30, and thus an amount of deflection of the sheet 711 (the sheet which is not adhered) on the side of the lid portion 4 is larger. Therefore, the phrase "substantially in parallel" used in the relationship with the above-described virtual plane includes not only an accurate parallel relationship between flat surfaces, but also an almost parallel state in which deflection of the sheets 711 and 712 is allowed.

As shown in FIG. 5, the pressing member 8 is partially fixed to the lid portion 4 by at least a part of the joint portion 82 being adhered to an inner surface of the lid portion 4. In the present embodiment, three locations of the joint portion 82 are adhered to the lid portion 4 using double-sided adhesive tapes 85. The first surface portion 831 (refer to FIG. 10) of the curved portion 83 faces the inner surface of the lid portion 4, and the joint portion 82 and the curved end portion 84 are arranged along the longitudinal direction (namely, the direction of the axial line X of the plug 72) of the lid portion 4. It is preferable for the joint portion 82 to be arranged in a position that is as close as possible to an upper edge portion (the edge portion on the lower side in FIG. 5) of the lid portion 4, where the lid portion 4 is joined to the top wall 32. Note that, in the present embodiment, the recessed portion 41 of the handle 40 (refer to FIG. 3) is positioned on the upper edge portion of the lid portion 4, and thus the joint portion 82 is arranged in a position in the vicinity of the recessed portion 41. In the present embodiment, in order to enhance the degree of freedom of the deflection of the curved portion 83, the curved portion 83 is not adhered to the lid portion 4. It is preferable for the pressing member 8 to be arranged on the lid portion 4 such that, when the lid portion 4 is joined to the main body portion 3, the curved end portion 84 comes into contact with the bottom wall 31.

Further, it is preferable for the pressing member 8 to be arranged inside the case 2 in a position that is separated from the plug 72 in the direction of the axial line X of the plug 72. With this arrangement, the pressing member 8 presses the ink bag 71 in the vicinity of the plug 72, and it is possible to reliably inhibit any obstruction in the movement of the ink toward the plug 72. Note that, in the present embodiment, the pressing member 8 is provided in a position that does not face an installation area of the movable member 5, so as not to interfere with the operation of the movable member 5, which is arranged in the vicinity of the plug 72. In the pressing member 8 of the present embodiment, a length in the direction in which the joint portion 82 extends is approximately two thirds of a length of the lid portion 4 in the front-rear direction. The pressing member 8 is arranged such that it faces the area 75 of the ink bag 71 when the lid portion 4 is joined to the main body portion 3, and the pressing member 8 extends to a front end portion that is joined to the front wall 34.

Figure 9:
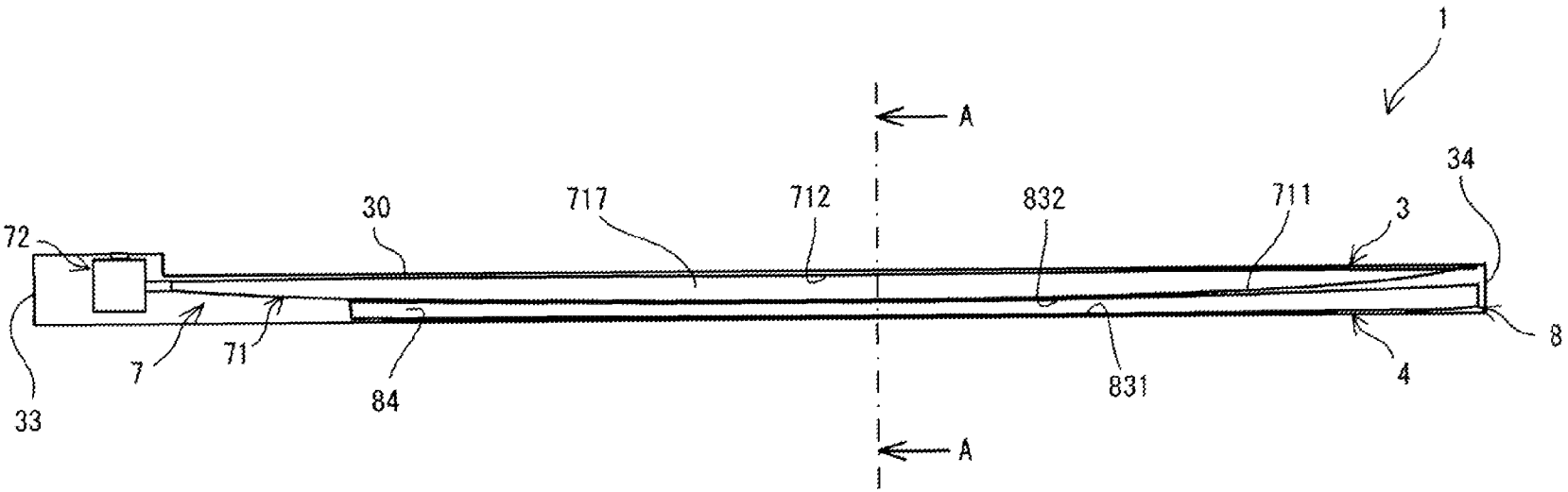
FIG. 9 is an explanatory diagram showing a state of the ink pack 7 (when full of ink) and the pressing member 8 as seen from below when the ink cartridge 1 is mounted in the inkjet printer 100.
Figure 10:
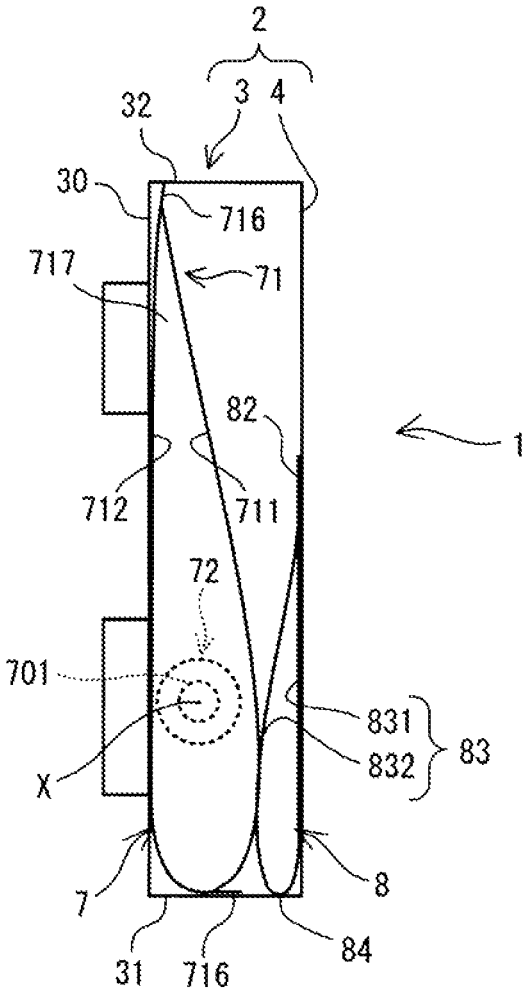
FIG. 10 is an explanatory diagram showing a state of the ink pack 7 and the pressing member 8 as seen in the direction of arrows A shown in FIG. 9.

As shown in FIG. 9 and FIG. 10, when the lid portion 4, to which the pressing member 8 is attached according to the above-described arrangement, is joined to the main body portion 3, the pressing member 8 is positioned inside the case 2, between the ink bag 71 and the lid portion 4. At least one section of the first surface portion 831 of the curved portion 83 is in contact with an inner surface of the lid portion 4 and a force is thus applied. At least one section of the second surface portion 832 is in contact with the sheet 711 of the ink bag 71 and a force is thus applied. The joint portion 82 is positioned on a side opposite to the bottom wall 31 with respect to the axial line X of the plug 72. Specifically, the joint portion 82 is positioned above the axial line X. The curved end portion 84 is closer to the bottom wall 31 than the axial line X. Specifically, the curved end portion 84 is positioned below the axial line X. In the present embodiment, the curved end portion 84 is in contact with the bottom wall 31.

When the ink bag 71 is full of ink, of the sheets 711 and 712 that form the ink storage portion 717, the sheet 711 deflects in the direction of the lid portion 4 and the ink storage portion 717 is in an inflated state. The pressing member 8 is structured such that, when the ink bag 71 is full of ink and the pressure of the ink inside the ink storage portion 717 presses the sheet 711 in the direction of the lid portion 4, the second surface portion 832 elastically deforms in the direction of the lid portion 4, resulting in deflection of the pressing member 8. As a result, a distance between the section of the first surface portion 831 that is in contact with the lid portion 4 and the section of the second surface portion 832 that is in contact with the sheet 711 is smaller than a distance between the first surface portion 831 and the second surface portion 832 when an external force is not applied to the curved portion 83. A restoring force (elastic force) of the sheet 81 of the pressing member 8 urges the second surface portion 832 in the direction of the left wall 30. Note that, as shown in FIG. 9, when the ink bag 71 is full of ink, the ink bag 71 is substantially uniformly inflated in the front-rear direction of the case 2 by the ink and presses the pressing member 8. Thus, the distance between the section of the first surface portion 831 of the pressing member 8 that is in contact with the lid portion 4, and the section of the second surface portion 832 that is in contact with the sheet 711 is substantially the same in the front-rear direction of the case 2. Changes in a state between the ink pack 7 and the pressing member 8 when the ink decreases will be explained in detail later.

It is preferable for the pressing member 8 to be at least partially fixed, in order to maintain an appropriate position inside the case 2 when the lid portion 4 is joined to the main body portion 3, but the pressing member 8 may be completely unfixed. In this case, before the lid portion 4 is joined to the main body portion 3, the pressing member 8 is arranged such that the second surface portion 832 faces the sheet 711 of the ink bag 71. After that, when the lid portion 4 is joined to the main body portion 3, the pressing member 8 is positioned inside the case 2, between the ink bag 71 and the lid portion 4. The pressing member 8 may be fixed to the lid portion 4 using a portion other than the joint portion 82. For example, one section of the curved portion 83 that is as far removed from the curved end portion 84 as possible may be adhered to the lid portion 4.

Figure 11:
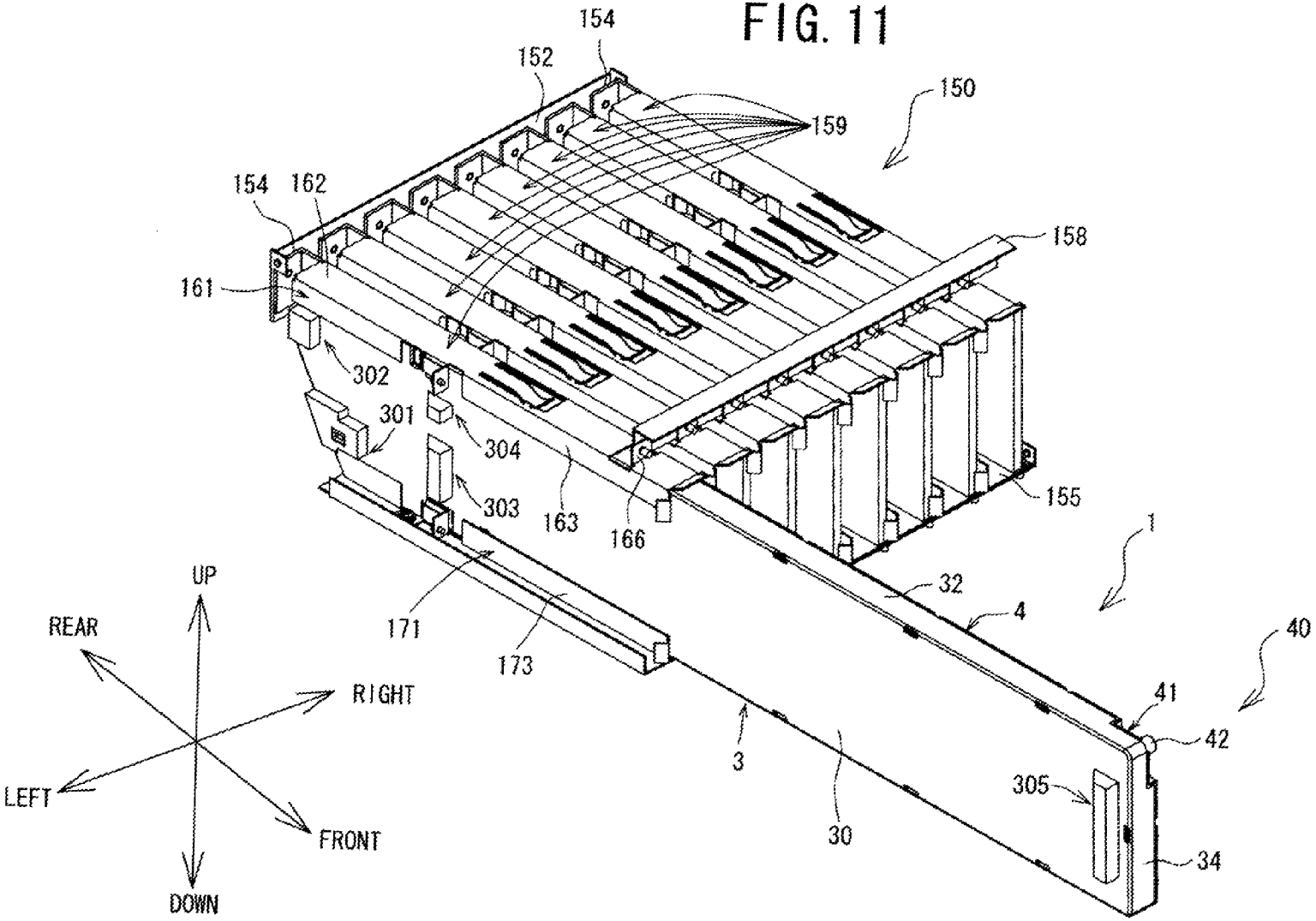
FIG. 11 is a perspective view of a holder unit 150.

An internal structure of the housing 111 of the cartridge mounting unit 110 shown in FIG. 1 will be explained with reference to FIG. 6, FIG. 11 and FIG. 12. The housing 111 is provided with the holder unit 150 (refer to FIG. 11), into which the cartridge 1 can be removably inserted, the connection portion 180 (refer to FIG. 6) to draw out the ink from the cartridge 1, and so on. Hereinafter, the holder unit 150 and the connection portion 180 will be explained in order.

A structure of the holder unit 150 will be explained with reference to FIG. 11. Note that FIG. 11 shows an example in which one of the cartridges I is inserted into the holder unit 150, and in order to simplify the drawing, an illustration of the other portions (including the housing 111) of the cartridge mounting unit 110 is omitted. Note that the up-down direction, the right diagonal direction, the upper left direction, the lower left direction and the upper right direction of FIG. 11 respectively correspond to the up-down direction, the front direction, the rear (back) direction, the left direction and the right direction of the holder unit 150 and the holders 159. As shown in FIG. 11, the holder unit 150 is provided with the holders 159, a mounting plate 155, a fixing plate 152 and a fixing plate 158. The eight holders 159 are arranged at equal intervals in the left-right direction on the mounting plate 155 and fixed to the mounting plate 155.

A structure of the holder 159 will be explained in detail with reference to FIG. 12 and FIG. 6. The holder 159 is a member that holds the cartridge 1 and guides the cartridge 1 to an appropriate mounting position. The holder 159 is formed of a plate-shaped member made of metal and its shape substantially corresponds to the shape of the cartridge 1. As shown in FIG. 12, the holder 159 includes a right guide portion 160, the upper rail portion 161 and the lower rail portion 171. The right guide portion 160 is a portion that guides a right end portion of the case 2 when the cartridge 1 is inserted into the holder 159. The right guide portion 160 is a substantially pentagonal shaped plate portion that substantially corresponds to the side view shape of a rear portion of the lid portion 4 of the cartridge 1. Note that an upper portion of a rear end portion of the right guide portion 160 protrudes to the rear. A bent portion 154 that bends to the left is formed at the leading end of the protruding upper portion of the rear end portion of the right guide portion 160. The right guide portion 160 is arranged along the up-down direction of the cartridge mounting unit 110 (refer to FIG. 1). The length of the right guide portion 160 in the longitudinal direction is slightly shorter than half the length of the cartridge 1 in the front-rear direction.

The upper rail portion 161 is a portion that protrudes to the left along an upper edge portion of the right guide portion 160. The upper rail portion 161 includes an upper guide portion 162 and an upper left guide portion 163. The upper guide portion 162 extends in a substantially perpendicular direction to the left from the upper edge portion of the right guide portion 160. The upper left guide portion 163 extends downward in a substantially perpendicular direction from a left edge portion of the upper guide portion 162. The upper rail portion 161 is a portion that guides an upper end portion (more specifically, an outer surface of the upper end portion of the top wall 32 and of the left wall 30) of the case 2 when the cartridge 1 is inserted into the holder 159. A width (a length in the left-right direction) of the upper guide portion 162 is substantially the same as a width (a distance from the left side surface to the right side surface) of the case 2. A first fixing tab 166 protrudes in the upward direction from the vicinity of the front end of the upper guide portion 162. As shown in FIG. 6, an abutment portion 169 bends and extends downward in a substantially perpendicular direction from the rear end of the upper guide portion 162. When the cartridge 1 is inserted in the holder 159, the abutment portion 169 abuts against the back surface portion 331 of the rear end of the cartridge 1 and thus restricts the cartridge 1 from moving further to the rear.

Figure 12:
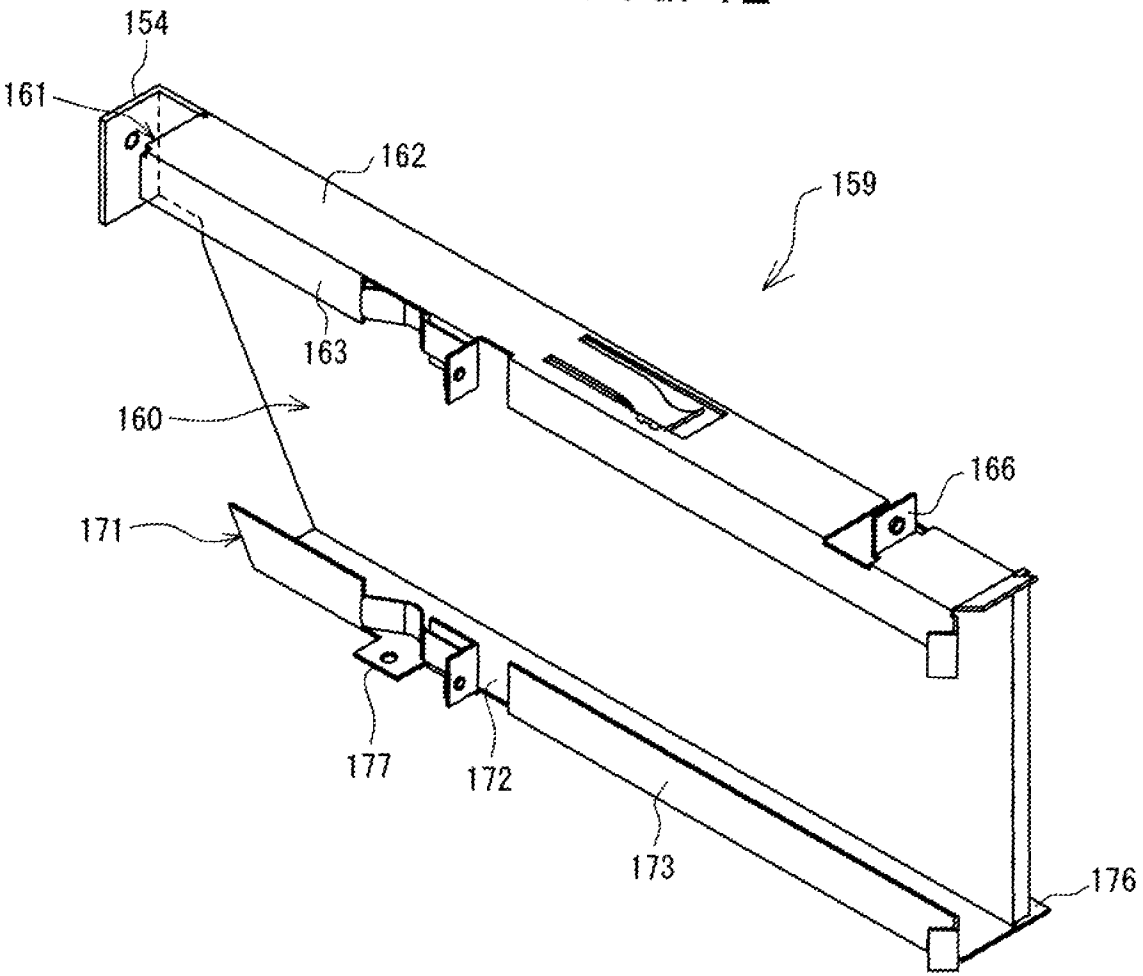
FIG. 12 is a perspective view of a holder 159.

As shown in FIG. 12, the lower rail portion 171 is a portion that protrudes to the left along a lower edge portion of the right guide portion 160. The lower rail portion 171 includes a lower guide portion 172 and a lower left guide portion 173. The lower guide portion 172 extends in a substantially perpendicular direction to the left from the lower edge portion of the right guide portion 160. The lower left guide portion 173 extends upwardly in a substantially perpendicular direction from a left edge portion of the lower guide portion 172. The lower rail portion 171 is a portion that guides a lower end portion of the case 2 when the cartridge 1 is inserted into the holder 159. The lower guide portion 172 faces the upper guide portion 162 and extends in parallel with the upper guide portion 162. A distance between the upper guide portion 162 and the lower guide portion 172 is substantially the same as a height in the up-down direction (a distance from the top surface to the bottom surface) of the case 2. A width (a length in the left-right direction) of the lower guide portion 172 is substantially the same as the width (the distance from the left side surface to the right side surface) of the case 2. A second fixing tab 176 protrudes to the right from the right end of a front end portion of the lower guide portion 172. A third fixing tab 177 protrudes to the left from a position further to the rear than a center of the lower guide portion 172.

When the user inserts the cartridge 1 into the holder 159, first, the user inserts a rear end portion of the cartridge 1 (on the side of the rear wall 33) from a front end portion of the holder 159. The cartridge 1 moves toward the rear side of the holder unit 150 while the right side surface (the outer surface of the lid portion 4), the top surface (the outer surface of the top wall 32) and the lower surface (the outer surface of the bottom wall 31) of the case 2 are respectively guided by the right guide portion 160, the upper rail portion 161 and the lower rail portion 171. A movement direction when the user removes the cartridge 1 from the holder 159 is an opposite direction to the movement direction when the cartridge 1 is inserted. More specifically, the longitudinal direction of the right guide portion 160 and the extending direction of the upper rail portion 161 and the lower rail portion 171 are an insertion/removal direction of the cartridge 1 with respect to the cartridge mounting unit 110.

Assembly of the holder unit 150 will be explained with reference to FIG. 11. The mounting plate 155, the fixing plate 152 and the fixing plate 158 are all thin plate members made of metal and have screw holes to fix the holders 159. An operator aligns the front and rear edges of the lower rail portions 171 of the eight holders 159 with the front and rear edges of the mounting plate 155, which is arranged substantially horizontally. The operator places the lower rail portions 171 of the eight holders 159 on the mounting plate 155 such that they are arranged at equal intervals in the left-right direction. The operator sequentially tightens screws into screw holes provided in the second fixing tabs 176 and the third fixing tabs 177 (refer to FIG. 12) of the holders 159 and screw holes in the mounting plate 155. The operator fixes the holders 159 to the mounting plate 155 by this method. The operator arranges the fixing plate 152 such that it abuts, from the rear, against the bent portion 154 of each of the holders 159, and fastens the fixing plate 152 to the bent portions 154 using screws, thus fixing the holders 159 to the fixing plate 152. The operator arranges the fixing plate 158 such that it abuts, from the rear, against the first fixing tab 166 of each of the holders 159 and fastens the fixing plate 158 to the first fixing tabs 166 using screws, thus fixing each of the holders 159 to the fixing plate 158. This completes the holder unit 150.

In a state in which the front edge of the mounting plate 155 is arranged along the lower edge portion of the opening 112 (refer to FIG. 1) of the housing 111, the holder unit 150 is fixed to a frame 116 (not shown in the drawings) that is provided on the rear side of the opening 112 inside the housing 111. The holder unit 150 is fixed to the frame 116 such that a plate surface of the mounting plate 155 faces downward toward the rear of the cartridge mounting unit 110 while being slightly tilted.

The connection portion 180 will be explained with reference to FIG. 6. The connection portion 180 is provided on the rear side of the holder unit 150. As shown in FIG. 6, the connection portion 180 includes a cylindrically shaped fixing portion 181, the tube 182 that is connected to the fixing portion 181, and the lead-out needle 183 to draw out the ink. Note that, although in actuality the fixing portion 181 is fixed inside the housing 111, an illustration of a fixing portion is omitted. The cartridge mounting unit 110 is provided with eight of the connection portions 180, corresponding to the eight holders 159. The lead-out needle 183 protrudes from a central portion at the front end of the fixing portion 181. One end of the tube 182 is connected to the rear end side of the fixing portion 181. The tube 182 extends inside the body portion 108 (refer to FIG. 1) via an opening (not shown in the drawings) on the right side of the housing 111, while the other end of the tube 182 is connected to the print head (not shown in the drawings).

In the course of the cartridge 1 being guided by the holder 159 and inserted into the holder unit 150, the lead-out needle 183 that protrudes to the front and a section of the fixing portion 181 enter the inside of the case 2 from the plug opening 335 provided in the inclined surface portion 332 of the cartridge 1. Then, the lead-out needle 183 pierces a central portion of the rubber plug 723 and thus the connection portion 180 is connected to the cartridge 1. When the back surface portion 331 of the cartridge 1 abuts against the abutment portion 169 of the holder 159, the insertion of the cartridge 1 into the holder 159 is complete. At this time, the lead-out needle 183 passes through the rubber plug 723 and a leading end portion of the lead-out needle 183 is disposed inside the hollow portion 700. A hole, through which the ink flows, is provided at the leading end portion of the lead-out needle 183, and thus the ink in the ink bag 71 can be supplied to the print head through the hollow portion 700, the lead-out needle 183 and the tube 182.

Changes in states of the ink pack 7 and the pressing member 8 when the ink decreases from a full state will be explained with reference to FIG. 9, FIG. 10 and FIG. 13 to FIG. 16. Note that, as described above with reference to FIG. 9 and FIG. 10, when the ink bag 71 is full of ink, the second surface portion 832 is deflected towards the lid portion 4 due to the pressure of the ink filled in the ink storage portion 717. After that, as the ink is consumed in order for the print head to perform printing, the ink flows out of the ink bag 71 via the connection portion 180. As the ink decreases, the ink bag 71 starts to deflate and change shape, such that the sheets 711 and 712 that form the ink storage portion 717 move closer to each other in the direction in which the lid portion 4 and the left wall 30 face each other. In accordance with the deformation of the ink bag 71, the second surface portion 832 deforms such that it inflates in the direction of the left wall 30 due to the restoring force of the sheet 81 (refer to FIG. 8), and presses the sheet 711 of the ink bag 71 toward the left wall 30.

Note that, as described above, in the holder unit 150 (refer to FIG. 11), the plate surface of the mounting plate 155 tilts slightly downward toward the rear of the cartridge mounting unit 110. The cartridge 1 is inserted into the holder unit 150 in a state in which the bottom wall 31 is on the lower side and the rear wall 33 is on the rear side, and thus the bottom wall 31 tilts downward toward the side of the rear wall 33. In other words, the ink bag 71 is disposed below the axial line X of the plug 72 and also extends diagonally downward toward the side of the first opening 701. Further, the sheets 711 and 712 extend in the up-down direction. Thus, the ink flows downward along the inner surfaces of the sheets 711 and 712 due to the weight of the ink itself, and further flows toward the first opening 701 of the plug 72 along the lower end portion of the ink storage portion 717. In other words, areas in which the ink is topically gathered occur in the ink storage portion 717.

Figure 13:
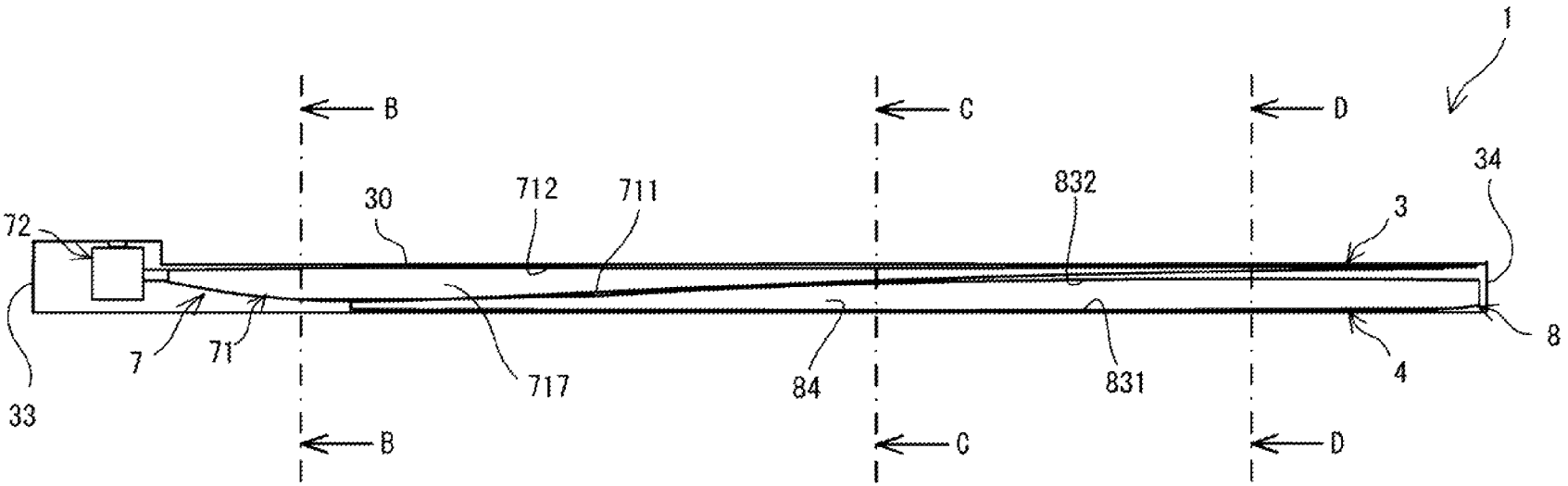
FIG. 13 is an explanatory diagram showing a state of the ink pack 7 (when not full of ink) and the pressing member 8 as seen from below when the ink cartridge 1 is mounted in the inkjet printer 100.
Figure 14:
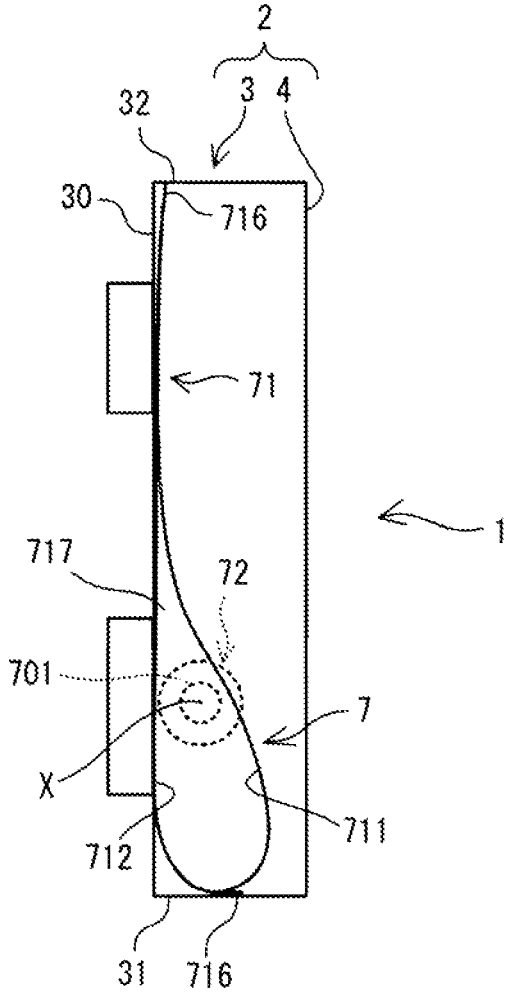
FIG. 14 is an explanatory diagram showing a state of the ink pack 7 when seen in the direction of arrows B shown in FIG. 13.
Figure 16:
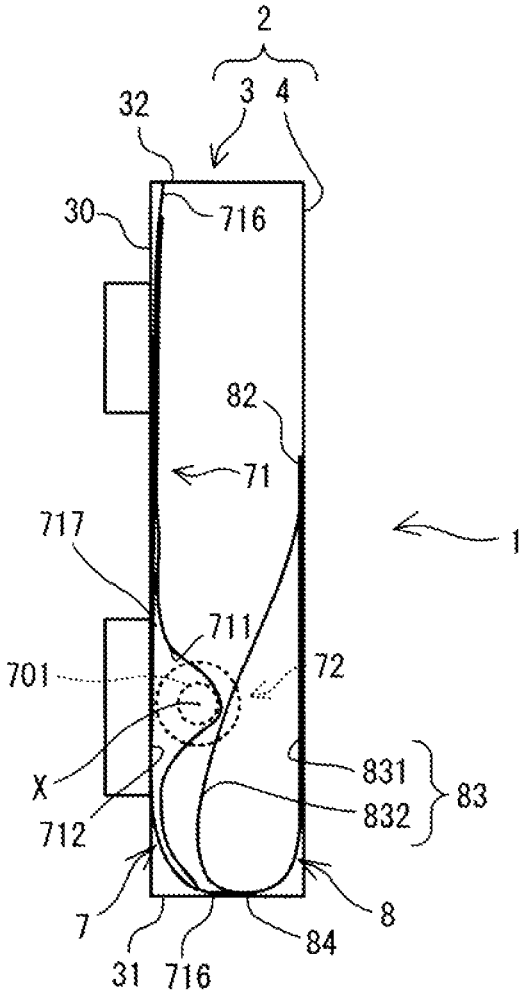
FIG. 16 is an explanatory diagram showing a state of the ink pack 7 and the pressing member 8 when seen in the direction of arrows D shown in FIG. 13.

As a result, the ink bag 71 deflects in a non-uniform manner in the up-down direction and in the front-rear direction of the case 2. For example, as shown in FIG. 14, in the rear portion of the case 2, namely in the portion in which the ink bag 71 does not face the pressing member 8, the sheets 711 and 712 come into contact with each other at an upper portion of the ink storage portion 717, and are separated from each other at a lower portion. Further, as shown in FIG. 13, in a portion that is on the side of the front wall 34, the sheets 711 and 712 come closer together and come into contact with each other more quickly than in a portion that is on the side of the rear wall 33, where the plug 72 is positioned. In accordance with the shape of the ink bag 71 that deforms in a non-uniform manner, the pressing member 8 deflects in a non-uniform manner in the up-down direction and in the front-rear direction of the case 2. For example, as shown in FIG. 13, a portion of the pressing member 8 that faces the portion at which the sheets 711 and 712 come into contact with each other on the side of the front wall 34 does not come into contact with the sheet 711. As shown in FIG. 16, the distance between the first surface portion 831 and the second surface portion 832 is at a maximum.

Figure 15:
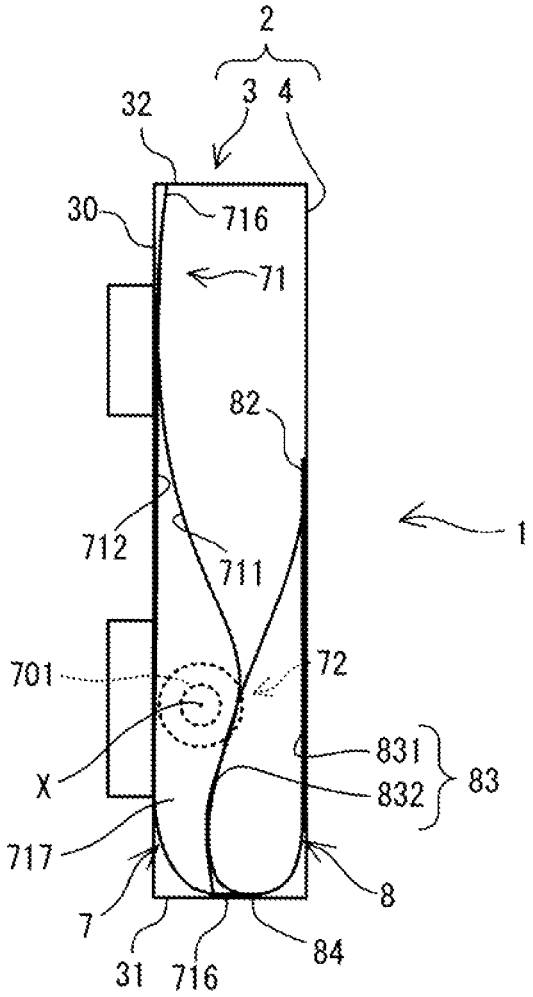
FIG. 15 is an explanatory diagram showing a state of the ink pack 7 and the pressing member 8 when seen in the direction of arrows C shown in FIG. 13.

As shown in FIG. 13, the sheets 711 and 712 move close to each other in the vicinity of a central portion of the case 2 in the front-rear direction. The second surface portion 832 deforms such that it inflates in the direction of the left wall 30, and is urged by the sheet 711. The elastic force of the resulting elastic deformation presses the sheet 711 in the direction of the left wall 30. As shown in FIG. 15, in the vicinity of the central portion of the case 2 in the front-rear direction also, as the ink decreases, the upper portions of the sheets 711 and 712 come into contact with each other. As the second surface portion 832 presses the sheet 711 in the direction of the left wall 30, the sheet 711 deflects along the second surface portion 832. At that time, the force with which the second surface portion 832 presses the sheet 711 in the direction of the left wall 30 is strongest at the portion at which the distance between the first surface portion 831 and the second surface portion 832 is at the maximum. The curved end portion 84 is in contact with the bottom wall 31 and thus, the second surface portion 832 inflates in the direction of the left wall 30 such that it pushes the lower portion of the ink storage portion 717 upward. As a result of this, the ink that is gathered in the lower portion of the ink storage portion 717 moves upward. The more the ink moves upward, the more easily it flows toward the first opening 701 of the plug 72. Furthermore, as shown in FIG. 13, the more the ink bag 71 deflates further away from the plug 72, the greater the distance becomes between the first surface portion 831 and the second surface portion 832 of the pressing member 8, and the more the pressing member 8 presses the ink bag 71. The ink flows more easily in the forward direction where the pressing member 8 is not pressing, namely, it flows more easily in the direction of the plug 72.

As described above, the cartridge 1 of the present embodiment is provided with the ink bag 71 and the pressing member 8 inside the case 2. The pressing member 8 has the curved portion 83 that is formed by curving the sheet 81, which has lower flexibility that that of the two sheets 711 and 712 that form the ink bag 71. The pressing member 8 is arranged inside the case 2 between the ink bag 71 and the lid portion 4 such that a force is applied to it. Due to the above-described effects, the pressing member 8 can efficiently move the ink toward the plug 72. Further, while the pressing member 8 deforms elastically in a non-uniform manner in accordance with the shape of the ink bag 71 that is deformed by the movement of the ink inside the ink bag 71, the pressing member 8 presses the ink bag 71 due to the resulting elastic force. Thus, compared to a case in which a member that applies the pressing force uniformly presses the ink bag 71, it is possible to inhibit the ink that remains inside the ink bag 71 from dispersing and spreading out. In the present embodiment, the effects of the pressing member 8 are explained while taking as an example the cartridge 1 that is inserted in the printer 100. However, the pressing member 8 can achieve similar effects even when the cartridge 1 is placed on a flat surface etc. in a state in which the bottom wall 31 is on the lower side, irrespective of whether it is inserted in the printer 100.

Various modifications can be made to the present disclosure in addition to the above-described embodiment. Hereinafter, examples of the modifications that can be added to the above-described embodiment will be explained. For example, it is sufficient that the pressing member has one surface (a first surface) of a sheet (which has lower flexibility than that of the sheets of the ink bag) facing inward, and includes a surface portion that curves toward the outside such that at least one end portion of the sheet faces the first surface. The pressing member may thus be formed from a sheet having a shape other than a rectangle (a trapezoid shape, an elliptical shape, an arch shape or so on, for example). When the pressing member has a portion where a pair of end portions of the sheet are joined, such as the joint portion 82, a stable shape can be maintained, including the curved portion. However, the end portions of the sheet need not necessarily be joined.

Figure 17:
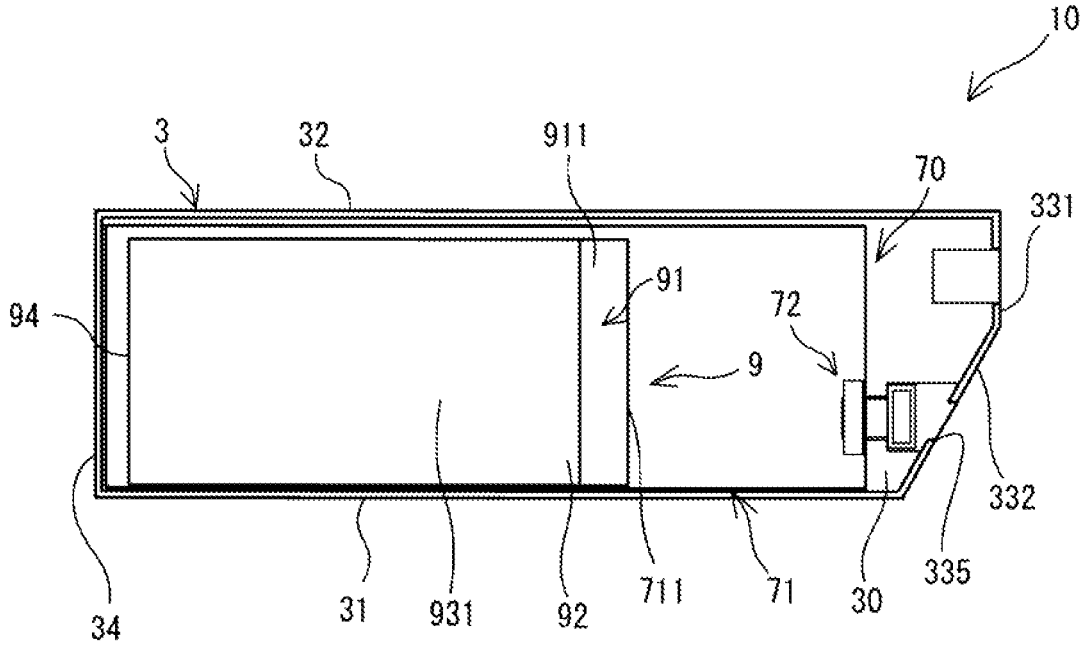
FIG. 17 is an explanatory diagram showing a positional relationship of an ink pack 70 and a pressing member 9 of an ink cartridge 10 according to a modified example.
Figure 18:
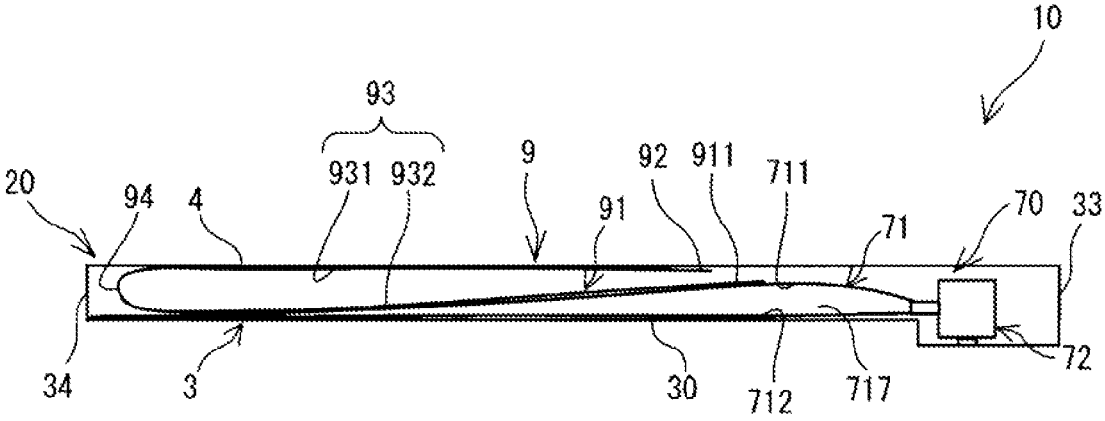
FIG. 18 is an explanatory diagram showing a state of the ink pack 70 (when not full of ink) and the pressing member 9 as seen from the side when the ink cartridge 10 is placed in a state in which a left wall 30 is on the lower side.

For example, as shown in FIG. 17 and FIG. 18, a pressing member 9 is formed simply by curving a rectangular-shaped sheet 91 such that a first surface 911 faces an end portion 92. The pressing member 9 includes a curved portion 93 that includes a first surface portion 931 and a second surface portion 932, and a curved end portion 94. The pressing member 9 is not provided with a joint portion. A length, in the front-rear direction; of a cartridge 10 is shorter than that of the cartridge 1 of the above-described embodiment. Specifically, a case 20 and an ink pack 70 of the cartridge 10 are shorter than the case 2 and the ink pack 7 of the above-described embodiment. The pressing member 9 is housed in the case 2 such that an orientation of the curved end portion 94 is substantially parallel to the front wall 34, at least one section of the first surface portion 931 is in contact with the inner surface of the lid portion 4 and at least one section of the second surface portion 932 is in contact with the sheet 711 of the ink bag 71. The first surface portion 931 may be partially fixed to the lid portion 4, but need not necessarily be fixed.

When the user places the cartridge 10 on a flat surface etc. in a state in which the left wall 30 is on the lower side, as the ink inside the ink bag 71 decreases, the second surface portion 932 of the pressing member 9 inflates in the direction of the left wall 30. The second surface portion 932 presses the sheet 711 in the direction of the left wall 30. Thus, the pressing member 9 can efficiently move the ink toward the plug 72.

Of the wall portions forming the case 2, at least some of the bottom wall 31, the top wall 32, the back surface portion 331 and the front wall 34 may be omitted. For example, the front wall 34 may be omitted. The bottom wall 31 and the top wall 32 need not necessarily cover the whole of the longitudinal direction of the case 2, and part of the bottom wall 31 and the top wall 32 may have an opening. The bottom wall 31, the top wall 32, the rear wall 33 and the front wall 34 need not all necessarily be provided on the main body portion 3, and may be provided in total or in part on the lid portion 4.

In the holder unit 150, the mounting plate 155 may be arranged such that it is substantially horizontal and does not tilt in the downward direction toward the rear. A structure to insert the cartridge 1 into and remove the cartridge 1 from the inkjet printer 100 is not limited to the holder unit 150 having the holders 159. For example, in the inkjet printer 100, paths may simply be provided inside the housing 111 along which each of the cartridges 1 can be guided in the direction of insertion and removal.

What is claimed is:

1. An ink cartridge comprising:

an ink bag which is formed in a bag shape and which includes two layers of flexible sheets that are disposed to face each other, and which stores ink inside;

a plug which is provided on the ink bag and which includes a hollow portion that leads from a first opening that is communicatively connected with the ink bag to a second opening that opens to the outside;

a case that is substantially box-shaped, and that includes a first wall portion and a second wall portion, which are a pair of wall portions whose longitudinal direction is an axial line of the plug and which are arranged substantially in parallel with the axial line, a third wall portion that is a wall portion arranged substantially perpendicularly with respect to an extending planar direction of the pair of wall portions and diagonally with respect to the axial line, and a penetration portion that is provided in the third wall portion such that the penetration portion faces the second opening of the plug, the case housing the ink bag such that sheet surfaces of the two layers of sheets respectively face the first wall portion and the second wall portion; and a pressing member that includes a curved portion, which is a surface portion formed by curving, toward an outer side, a sheet having lower flexibility than that of the two layers of sheets such that a one surface of the sheet is on an inner side, such that at least one end portion of the sheet faces the one surface, and such that an empty space is created on the inner side, wherein inside the case; between the ink bag and the first wall portion, the pressing member is elastically deformed and a restoring force occurs in directions in which one section and another section are separated from each other by the one section of the curved portion being in contact with the first wall portion and the other section other than the one section of the curved portion being in contact with a first layer portion that is one of the two layers of sheets, and the empty space is positioned between the one section and the other section.

2. The ink cartridge according to claim 1, wherein the ink bag is arranged inside the case such that the axial line of the plug is positioned closer to a first end portion that is one end portion of the case in a direction that orthogonally intersects with the axial line, the pressing member includes a joint portion that is a portion formed by joining a pair of end portions of the sheet on the side of the one surface, and a curved end portion that is a curved end portion facing, the joint portion, and the pressing member is arranged inside the case such that the joint portion is positioned On an opposite side to the first end portion with respect to the axial line, and such that the curved end portion is positioned closer to the first end portion than the axial line.

3. The ink cartridge according to claim 1, wherein the pressing member is arranged in a position that is separated from the plug in a direction of the axial line.

4. The ink, cartridge according to claim 1, wherein when the ink bag deforms such that the two layers of sheets move closer to each other in the direction in which the first wall portion and the second wall portion face each other, the pressing member deforms such that a distance between the one section of the curved portion that is in contact with the first wall portion and the other section of the curved portion that is in contact with the first layer portion increases.

5. The ink cartridge according to claim 2, wherein the case includes, on the first end portion, a fourth wall portion that connects to the first wall portion and the second wall portion, and the curved end portion is in contact with the fourth wall portion.

* * * * *